US008062496B2

(12) United States Patent
Tomantschger

(10) Patent No.: US 8,062,496 B2
(45) Date of Patent: Nov. 22, 2011

(54) ELECTROPLATING METHOD AND APPARATUS

(75) Inventor: Klaus Tomantschger, Mississauga (CA)

(73) Assignee: Integran Technologies Inc., Toronto, Ontario (CA)

( * ) Notice: Subject to any disclaimer, the term of this patent is extended or adjusted under 35 U.S.C. 154(b) by 680 days.

(21) Appl. No.: 12/081,623

(22) Filed: Apr. 18, 2008

(65) Prior Publication Data

US 2010/0006445 A1 Jan. 14, 2010

(51) Int. Cl.

| | |
|---|---|
| ***C25D 1/00*** | (2006.01) |
| ***C25D 5/18*** | (2006.01) |
| ***C25D 5/02*** | (2006.01) |
| ***C25D 17/28*** | (2006.01) |
| ***C25D 5/00*** | (2006.01) |
| ***C25D 21/10*** | (2006.01) |
| ***C25D 7/04*** | (2006.01) |
| ***C25D 5/10*** | (2006.01) |

(52) U.S. Cl. ..... 205/67; 205/96; 205/102; 205/103; 205/128; 205/145; 205/147; 205/148; 205/151; 205/170

(58) Field of Classification Search ..... 205/103, 205/95, 105, 128, 238, 261, 107, 345; 204/267
See application file for complete search history.

(56) References Cited

U.S. PATENT DOCUMENTS

| | | | | |
|---|---|---|---|---|
| 3,269,932 | A | 8/1966 | Worsham | |
| 3,365,382 | A | 1/1968 | Godschalx | |
| 3,909,368 | A * | 9/1975 | Raymond et al. | 205/128 |
| 4,077,864 | A * | 3/1978 | Vanderveer et al. | 204/285 |
| 4,197,169 | A * | 4/1980 | Zahn et al. | 205/343 |
| 4,277,317 | A * | 7/1981 | Grimes et al. | 205/343 |
| 4,377,445 | A * | 3/1983 | Grimes | 205/343 |
| 4,565,607 | A | 1/1986 | Hanak | |
| 4,686,014 | A | 8/1987 | Pellegrino | |
| 5,000,827 | A | 3/1991 | Schuster et al. | |
| 5,312,532 | A * | 5/1994 | Andricacos et al. | 204/229.4 |
| 5,352,266 | A | 10/1994 | Erb | |
| 5,421,987 | A | 6/1995 | Tzanavaras | |
| 5,433,797 | A | 7/1995 | Erb | |
| 5,756,874 | A | 5/1998 | Steward | |
| 5,776,327 | A | 7/1998 | Botts | |
| 6,027,631 | A | 2/2000 | Boradbent | |
| 6,776,891 | B2 * | 8/2004 | Chen et al. | 205/89 |
| 6,884,335 | B2 * | 4/2005 | Webb et al. | 205/104 |
| 6,893,550 | B2 * | 5/2005 | Dubin et al. | 205/103 |

(Continued)

FOREIGN PATENT DOCUMENTS

WO WO 2007006690 A1 * 1/2007

OTHER PUBLICATIONS

International Preliminary Report on Patentability for PCT/CA2009/000264, Oct. 19, 2010, 5 pages.

*Primary Examiner* — Alexa Neckel
*Assistant Examiner* — Brian Cohen
(74) *Attorney, Agent, or Firm* — Bacon & Thomas, PLLC

(57) ABSTRACT

An apparatus and method is disclosed for simultaneously electroplating at least two parts in a series electrical configuration in an electroplating system using a shared electrolyte with excellent consistency in thickness profiles, coating weights and coating microstructure. Parts in high volume and at low capital and operating cost are produced as coatings or in free-standing form.

25 Claims, 6 Drawing Sheets

U.S. PATENT DOCUMENTS

| | | | | |
|---|---|---|---|---|
| 7,320,832 | B2 | 1/2008 | Palumbo | |
| 7,354,354 | B2 | 4/2008 | Palumbo | |
| 2005/0205425 | A1* | 9/2005 | Palumbo et al. | 204/499 |
| 2006/0135281 | A1* | 6/2006 | Palumbo et al. | 473/316 |
| 2006/0160636 | A1 | 7/2006 | Palumbo | |
| 2006/0272949 | A1* | 12/2006 | Detor et al. | 205/238 |
| 2009/0159451 | A1* | 6/2009 | Tomantschger et al. | 205/96 |
| 2009/0188803 | A1* | 7/2009 | Jensen et al. | 205/96 |

* cited by examiner

ELECTROPLATING METHOD AND APPARATUS

TECHNICAL FIELD

The invention is directed to simultaneously electroplating metallic material layers onto multiple parts in an electroplating system having a common circulating electrolyte using DC or pulse electrodeposition. Two or more parts are electrically connected in series to form a string and one or more strings of parts is/are simultaneously plated to produce articles with consistent layer thickness profiles and consistent layer weights.

BACKGROUND OF THE INVENTION

Modern lightweight and durable articles require a variety of physical properties which frequently cannot be achieved with conventional coarse-grained metallic materials. Synthesis of fine-grained metallic materials using electrodeposition is described in the prior art. For structural applications these electroplated or electroformed parts require much greater thicknesses than used in coatings for wear, corrosion or aesthetic purposes, i.e., the required thickness of structural metallic layers range from 25 microns to 5 cm and, unlike prior art applications, the structural layers and coatings require weight and thickness tolerances not consistently achievable with conventional rack plating techniques where all parts to be plated are electrically connected in parallel. Unlike thin coatings, in these applications the weight of the electroplated material typically ranges from 5-100% of the total weight of the article.

As conventional rack and barrel plating, constituting "parallel plating" characterized by poor individual part thickness and weight control, does not provide sufficient part reproducibility and industrial settings do not permit plating one part at the time in a plating cell to achieve tight part weight and thickness specifications, plating methods are sought enabling the economic and simultaneous production of parts by a process which is readily scalable.

Methods for producing multiple parts in a single plating tank using DC are known.

Andricacos in U.S. Pat. No. 5,312,532 (1994) discloses a multi-compartment electroplating system for electroplating two or more disks simultaneously such that the electrodeposited material is substantially uniform in thickness and composition. Electroplating solution is circulated between a reservoir and a multi-compartment tank which has one cathode-paddle-anode (CPA) assembly for each compartment. Each CPA assembly has an anode, a cathode adapted for holding a wafer and employing a single thieving electrode which covers the entire floor of the compartment not covered by the wafer, and a paddle. Andricacos' plating process specifies the use of one power supply to provide current to every anode-cathode set and a second power supply to provide power to each anode and thieving electrode set.

SUMMARY OF THE INVENTION

It is the principal object of the invention to simultaneously plate at least two parts, in a series electrical configuration in an electroplating system using a shared electrolyte, with excellent consistency in the thickness profiles, the coating weight and coating microstructure in high volume and at low capital and operating cost.

It is the principal object of an embodiment of the invention to provide a method for simultaneously electrodepositing a metallic layer on each of at least two permanent or temporary substrates comprising the steps of:

(a) electrically connecting a plurality of ionically intercommunicating electrodepositing zones in series;

(b) supplying electrical power in series from a single source to at least two of the ionically intercommunicating electrodepositing zones;

(c) immersing each substrate of the at least two substrates in aqueous electrolyte shared among the ionically intercommunicating electrodepositing zones;

(d) supplying a negative charge to each substrate and providing equal current flow to each substrate.

It is an object of each case of the first embodiment to provide a method for simultaneously preparing a plurality of plated parts with each containing an electrodeposited metallic layer on at least a portion thereof, where each electrodepositing zone has at least one cathodic region and the substrate therein is rendered cathodic in order to electrodeposit a metallic material on each substrate in each electrodepositing zone.

It is an object of a preferred embodiment of the invention to provide a method where at least four articles are electrodeposited in two series strings simultaneously with each string powered by a different power source and wherein said power sources are synchronized to minimize voltage fluctuations from electrodepositing zone to electrodepositing zone.

It is an object of the invention to provide a method where the electrodepositing parameters are selected so that the electrodeposited metallic material layers have a same microstructure selected from the group consisting of an average grain size ranging from 2 nm to 5,000 nm, a coarse-grained microstructure with an average grain size over 5,000 nm and an amorphous microstructure.

It is an object of one case of the invention to provide a method where the electrodepositing parameters are selected so that all the electrodeposited metallic layers have a same graded grain size.

It is an object of an embodiment of the invention to produce multiple parts simultaneously in a plating system using a shared electrolyte comprising electrodepositing metallic-materials optionally containing particulates as a coating (on at least part of a surface of a substrate) or in free-standing form. The electrodeposited material represents between 5 and 100% of the weight of the article. The microstructure of the metallic material preferably has a crystalline microstructure with a fine grain size, i.e., with an average grain size between 2 nm and 5,000 nm. The microstructure can, however, also be amorphous and/or coarse-grained (average grain size >5 μm or >10 μm).

The temporary or permanent substrates to be provided with a metallic material layer electrodeposited over at least over part of a surface include flat plates, tubular objects and/or complex articles. Articles made in large volume using the process described include medical equipment including orthopedic prosthesis, stents and surgical tools; cylindrical objects including gun barrels, shafts, tubes, pipes and rods; molds and molding tools and equipment; sporting goods including golf shafts, heads and faceplates, baseball bats, hockey sticks, fishing, skiing and hiking poles; components and housings for electronic equipment including cell phones, personal digital assistants (PDAs) devices, walkmen, discmen, MP3 players, digital cameras and other recording devices; and automotive components including fuel rails, grill-guards; brake or clutch parts, pedals, running boards, spoilers, muffler components, wheels, vehicle frames, structural brackets and the like. The metallic material layer(s) can be electrodeposited onto the inside or the outside of tubes, barrels, shafts, sticks, bats, rollers or complex parts.

"Bath management", as used herein means establishing and maintaining the constancy of the electrolyte during production and includes the bath temperature, removal of impurities by filtering, continuous additions of reactants, i.e., using metering pumps. As "bath management" is time consuming and costly, plating of parts in a single plating tank using a common electrolyte (also referred to as the "bath" in this context) is of paramount importance.

It is an object of an embodiment of the invention to use a DC and/or pulse electrodeposition process relying on no pulsing, monopolar pulsing and/or bipolar pulsing in a plating system using a shared electrolyte to deposit the metallic material simultaneously onto several parts in a series electrical connection. The invention provides microstructures ranging from fine-grained crystalline to coarse-grained crystalline (average size greater than 10 microns) and/or to amorphous structures. In all cases the metallic material is applied to a thickness over a layer cross-section in the deposition direction of at least at least 20 microns, and even more preferably at least 50 microns. Overall the metallic material represents at least 5%, preferably 10%, more preferably 25% and up to 100%, of the total weight of the part/article.

It is within the scope of an embodiment of the invention to expose a plated part to at least one subsequent finishing operation selected from the group of grinding, polishing, electroplating including chromium plating, physical vapor deposition (PVD), chemical vapor deposition (CVD), ion-plating, anodizing, powder coating, painting, and screen printing.

It is an object of a preferred embodiment of the invention to simultaneously plate at least two tubular parts, in a series electrical configuration in an electroplating system using a shared electrolyte, with excellent consistency in the circumferential coating thickness by rotating each part and obtaining uniform thickness profiles along the length by suitably employing shielding and current thieving to overall achieve consistent part coating weights, thickness profiles and coating microstructures.

It is an object of an embodiment of the invention to simultaneously plate at least two parts, in a series electrical connection or configuration in an electroplating system using a shared electrolyte, with uniform or suitably tapered thickness profiles and consistent coating weights and coating microstructures.

It is an object of a preferred embodiment of the invention to simultaneously plate at least two parts, in a series electrical configuration in an electroplating system using a shared electrolyte, with consistent coating weights with the maximum weight difference of any part from the average part weight plated at the same time in each run being less than ±20%, preferably less than ±10%, and even more preferably less than ±5% and/or the standard weight deviation per run divided by the average weight per run of less than ±5%, preferably ±2.5% and even more preferably ±1.5%, and/or in the case of four or more substrates a kurtosis per run of ≦10,preferably ≦2.5 and even more preferably ≦0.

It is an object of a preferred embodiment of the invention to simultaneously plate at least two parts, in a series electrical configuration in an electroplating system using a shared electrolyte, where the electrodepositing parameters are selected so that each electrodeposited metallic layer has a thickness ranging from 20 microns to 5 cm and wherein part-to-part variability obtained is manifested by a ratio of maximum layer thickness to average layer thickness of less than ±0% and ratio of layer thickness standard deviation to average layer thickness of less than ±20% and in the case of four or more substrates a kurtosis of less than 10.

It is an object of a preferred embodiment of the invention to simultaneously plate at least two parts, in a series electrical connection in an electroplating apparatus using a shared electrolyte, with consistent coating weights by minimizing shunt current flows between adjacent cells to ensure that the charge measured in coulombs (=A×s) supplied to each part remains uniform.

It is a further object of an embodiment of the invention to provide an apparatus for simultaneously electrodepositing a metallic material onto the surface of at least two substrates in a series electrical connection, said apparatus comprising:

(a) an electrolyte well, e.g. a central electrolyte well, filled with an electrolyte solution containing ions of the metallic material to be deposited;

(b) at least two plating cells, each providing an electrodepositing zone, electrically connected in series and powered by a single power supply;

(c) an electrolyte circulation loop for supplying said electrolyte solution to each plating cell from the well electrolyte and for returning said electroplating solution to said electrolyte well;

(d) each plating cell comprising:

(i) at least one anode, (ii) a cathode capable of receiving and holding one of a temporary or permanent substrate to be plated optionally positioned in relation to a thieving electrode, (iii) agitated electrolyte containing ions of metallic material to be deposited, (iv) means for minimizing voltage differences and shunt currents between plating cells selected from the group consisting of divider plates, synchronized power supplies and tortuous electrolyte circulation pathways, (v) optionally a shield disposed between the anode and the cathode, the shield being configured to mask between 0 and 90% of the anode or the cathode.

(e) at least one power source electrically connected to at least two plating cells.

It is a further object of the invention to provide in an embodiment an apparatus for simultaneously electrodepositing a metallic material onto the surface of at least four substrates in a series electrical connection employing at least two power supplies, said apparatus comprising:

(a) an electrolyte well, e.g. a central electrolyte well, filled with an electrolyte solution containing ions of the metallic material to be deposited;

(b) at least two plating cells electrically connected in series;

(c) at least two strings of at least two plating cells each connected in series;

(d) an electrolyte circulation loop for supplying said electrolyte solution to each plating cell from the electrolyte well and for returning said electroplating solution to said electrolyte well;

(e) at least two power supplies, each electrically connecting a different string of plating cells, where the power supplies are synchronized with respect to current on time, off time, and reverse time and the respective current densities at all times during a plating cycle;

(f) each plating cell providing an electrodepositing zone and comprising:

(i) at least one anode, (ii) a cathode capable of receiving and holding one of a temporary or permanent substrate to be plated optionally positioned in relation to a thieving electrode, (iii) agitating means selected from the group consisting of a pump, educators, stirrers, air agitation and ultrasonic agitation for agitating electrolyte solution in the cell, (iv) means for minimizing voltage differences and shunt currents between plating cells selected from the group consisting of divider plates, synchronized power supplies and tortuous electrolyte circulation pathways, (v) optionally a shield disposed between the anode and the cathode, the shield being configured to mask between 0 and 90% of the anode or the cathode.

It is a further object of a preferred embodiment of the invention to simultaneously plate at least two parts, in a series electrical connection in an electroplating system using a shared electrolyte, with consistent coating weights by minimizing the number of power supplies required to plate multiple parts and the ratio between the total number of power supplies used and the total number of parts produced in each run is ≦1,preferably ≦½ and even more preferably ≦⅓.

It is a further object of a preferred embodiment of the invention to simultaneously plate at least four parts, at least two parts each in a series electrical configuration and at least two sets of at least two-plating cells connected in series simultaneously in an electroplating system using a shared electrolyte.

It is a further objective of the invention to simultaneously plate at least two parts, each in a series electrical connection in an electroplating apparatus using a shared electrolyte, with consistent circumferential thickness profiles between parts by rotating each part to be plated at rotation speeds between 1 and 1,500 RPM against stationary soluble or dimensionally stable anodes.

These objectives are achieved by "series plating" of parts while maintaining control (or quasi-control) of the coulombs supplied to each individual part. Several "strings" are plated simultaneously by providing one power supply for each string to control the appropriate coulomb supply to all parts in a series array in a shared electrolyte. For this purpose all power supply modules are suitably synchronized to minimize cell voltage differences between individual cells in real time, i.e., in the case of using pulse electrodeposition the identical plating schedule is imposed on all parts simultaneously at all times, including, the on times, off times, reverse times and the respective peak forward current and peak reverse current which can be achieved by controlling all power supply modules from a central power supply control module. The plating schedule profiles (pulse rise times, fall times) are also kept the same by using power supplies with similar specifications. To enable utilization of a common electrolyte and maintain control over each part's coulomb supply, "shunt currents" between cells/parts are minimized by appropriate use of dividers/baffles and high resistance ionic pathways are provided for the entire electrolyte circulation loop (electrolyte feed, electrolyte overflow, electrolyte recirculation). This is accomplished by maintaining a principal electrolyte well containing a heater, filter, and pump. A tank can be divided into several compartments housing the individual cells which are all sharing the common electrolyte and as such all cells/zones are ionically intercommunicating. Suitable pipes/eductors enable the electrolyte to be fed into each cell from a common manifold and each cell is preferably separated from the adjacent cell(s) by divider plates. The electrolyte in each cell/zone is agitated by means selected from the group of a mechanical pump, educators, stirrers, air agitation, ultrasonic agitation, gravity drainage or the like. Each cell typically has its own weir/electrolyte return flow manifold to enable electrolyte recirculation. The divider plates do not necessarily extend all the way to the top/bottom of the tank, and all cells are "ionically connected" at the top and/or bottom of the cells, and/or by the electrolyte feeding tubes and electrolyte return channels. The dividers and various tubes/channels, however, have been designed to sufficiently increase the "ionic resistance" between adjacent cells to provide for tortuous electrolyte pathways and to behave essentially like "totally ionically isolated tanks" as long as the cell operating voltages and the respective electrode potentials between adjacent cells do not vary by more than a critical amount to enable the achievement of the desired coating weight consistency.

Appropriate thickness profiles are achieved by suitably shielding the anodes and, optionally, by employing current thieves.

Conventional electroplating typically involves e.g. rack plating wherein the parts to be plated are all placed on a suitable "part rack". In this "parallel plating" configuration all parts are electrically connected to one power supply and the total current to the plating cell can be adjusted to determine the resulting total applied voltage between positive and negative lead busbars. The individual current and the coulombs supplied to each specific part and the resulting weight of each individual part can, however, not be controlled. As the individual current supplied to each part is affected by the ohmic and ionic resistances in this configuration, uniform part weights are only achieved if no differences in ohmic and ionic resistances exist in the system, which is almost never the case. While this approach is commonly used in the electroplating industry, and is appropriate for thin coatings where overall coating weight, uniformity and consistency is not an issue and coating weights and thickness can fluctuate by ±50% or more and incompletely coated parts are simply recoated, this approach is not acceptable for structural coatings requiring reproducible and consistent coating properties. The "parallel plating" approach relies on all parts to be uniform in electrical bulk and surface resistance and connected equally well to the rack (similar contact resistance) and e.g. any corroded or otherwise high ohmic resistance connection is avoided, as ultimately it is the individual part's potential which controls the current fraction it receives. As illustrated below, polarization curves corrected for internal resistance losses for typical electroplating systems have a very flat slope, i.e. a small change in part potential (a few tens or a few hundred mV) can result in a substantial change in current (1 ampere or tens of amperes) and as a result coulombs received, and therefore realized coating weights. To achieve the desired control using conventional plating techniques it becomes necessary to plate one part at the time which is time consuming, uneconomic and, for applications requiring a large number of parts, impractical.

The above recited objects are obtained by the invention herein (contrary to the case with conventional electroplating) which is directed to a method of applying a metallic material deposit, comprising the steps of electrodepositing a metallic material from an aqueous or non-aqueous electrolyte in a multi-cell electroplating system sharing a common electrolyte with the electrodeposition parameters being average current density ranging from 5 to 10,000 mA/cm$^2$; forward pulse on time ranging from 0.1 to 10,000 ms or as provided by DC electrodeposition processing; pulse off time ranging from 0 to 10,000 ms; reverse pulse on time ranging from 0 to 1,000 ms; peak forward current density ranging from 5 to 10,000 mA/cm$^2$; peak reverse current density ranging from 5 to 20,000 mA/cm$^2$ except when reverse pulse on time is zero as then the peak reverse current density is not applicable; frequency ranging from 0 to 1000 Hz; a duty cycle ranging from 5 to 100%; working electrode (anode or cathode) rotation speed ranging from 0 to 1,500 RPM; bath composition (containing metal ions to be plated in a concentration range of 0.01 to 20 moles per liter); bath (electrolyte) temperature ranging from 0 to 150° C.; bath pH ranging from 0 to 12; bath (electrolyte) agitation rate ranging from 1 to 6,000 ml/(min·cm$^2$) anode or cathode area; bath (electrolyte) flow direction at cathode ranging from tangential to incident (i.e. perpendicular); shielding anode(s) by physically covering between 0-95% of the geometrical anode surface area(s); and electrochemically inert material concentrations in the bath between 0 and 70 vol %.

In a series string the anodes and cathodes are electrically connected, i.e. anode of a cell 1 is connected to cathode of a cell 2 and anode of a cell 2 to cathode of a cell 3 and so forth to enable the simultaneous plating of multiple parts in a series arrangement. Optionally current thieves are provided to deal with edge effects, optimize thickness profiles and the like.

Method herein provides a uniform deposit thickness profiles, microstructures and weights for all parts plated simultaneously. The electroplated thickness ranges from 20 microns to 5 cm having preferably a fine grained microstructure with grain size ranging from 2 nm to 5,000 nm, a coarse grained microstructure with grain size greater than 5,000 nm or an amorphous microstructure and the maximum deposit weight difference of any parts from the average part weight plated at the same time in different cells, as well as the maximum ratio between standard deviation and average weight value are less than ±20%, preferably less than ±10%, preferably less than ±5% and more preferably less than ±2.5%.

As used herein the terms "product" and "deposit" means deposit layer or free-standing deposit body.

As used herein, the term "thickness" refers to depth in a deposit direction.

As used herein the term "average cathode current density" ($I_{avg}$) means the "average current density" resulting in depositing the metallic material and is expressed as the means of the cathodic minus the reverse charge, expressed in mA×ms divided by the sum of the on-time, off-time and reverse time expressed in ms, i.e., $=(I_{peak}\times t_{on}-I_{reverse}\times t_{an})/(t_{on}+t_{an}+t_{off})$; where "x" means "multiplied by".

As used herein the term "forward pulse" means cathodic deposition pulse affecting the metallic deposit on the work piece and "forward pulse on time" means the duration of the cathodic deposition pulse expressed in ms: $t_{on}$ As used herein the term "off time" means the duration where no current passes expressed in ms: $t_{off}$ As used herein the term "reverse pulse on time" means the duration of the reverse (=anodic) pulse: $t_{an}$ As used herein "electrode area" means the geometrical surface area effectively plated on the work piece which can be a permanent substrate or a temporary cathode expressed in cm$^2$.

As used herein the term "peak forward current density" means the current density of the cathodic deposition pulse expressed in mA/cm$^2$: $I_{peak}$ As used herein the term "peak reverse current density" means the current density of the reverse/anodic pulse expressed in mA/cm$^2$: $I_{reverse}$ or $I_{anodic}$ As used herein the term "duty cycle" means the cathodic on time divided by the sum of all times (on time, off time and anodic time (also referred to as reverse pulse on time)).

As used herein the "average" ($\overline{\chi}$) is defined as the arithmetic means of a set of data, e.g., the average weight is the arithmetic means of a set of weight data.

In statistics, the variance of a random variable, probability distribution, or sample is one measure of statistical dispersion, averaging the squared distance of its possible values from the expected value. Whereas the mean is a way to describe the location of a distribution, the variance is a way to capture its scale or degree of being spread out. The "standard deviation", is the square root of the variance and, as it has the same units as the original variable, it is commonly used to interpret the consistency of data. As used herein, the "standard deviation" (σ) is the root mean square deviation of values from their arithmetic mean according to the following formula:

$$\sigma = \sqrt{\frac{\sum (x-\overline{x})^2}{(n-1)}}$$

wherein and $\overline{\chi}$ is the sample arithmetic average and n is the sample size.

As used herein the "kurtosis" of a data set characterizes the relative peakedness or flatness of a distribution compared with the normal distribution. Kurtosis is defined as the fourth cumulant divided by the square of the variance of the probability distribution. A positive sample kurtosis indicates a relatively peaked distribution of a set of data whereas a negative sample kurtosis indicates a relatively flat distribution of the data set. Higher kurtosis means more of the variance is due to infrequent extreme deviations, as opposed to frequent modestly-sized deviations. Kurtosis (G) is defined as:

$$G = \left\{\frac{n(n+1)}{(n-1)(n-2)(n-3)}\sum\left(\frac{x_j-\overline{x}}{\sigma}\right)^4\right\} - \frac{3(n-1)^2}{(n-2)(n-3)}$$

wherein $x_i$ is the $i^{th}$ value, and $\overline{\chi}$ is the sample arithmetic average, n is the sample size and σ is the standard deviation.

As used herein minimum or maximum "weight difference" expressed in percent is the observed minimum or maximum value of each run or data set divided by the average weight of the data set multiplied by 100.

As used herein "percent weight deviation" is the standard weight deviation of each run divided by the average weight of said run multiplied by 100 expressed as "STDEV/Average Weight [%]" in the examples.

As used herein the term "chemical composition" means chemical composition of the electrodeposited material.

As used herein "electroplating zone" and "plating cell" means a single "plating unit" comprised of an anode and a cathode immersed in the plating bath. The multi-cell plating system contains a number of cells/zones and all cells/zones share a common electrolyte.

As used herein "shielding" of anodes involves shielding from 0 to 95% of the anode geometrical area using, e.g., a polypropylene sheet or other electrolyte impermeable foil or membrane to effect local current densities and deposit thicknesses, as required. As the person skilled in the art will know, shielding increases the voltage drop between the electrodes and hence for the same current the cell voltage increases with the level of shielding.

As used herein "thieving" of a work piece entails attaching an auxiliary cathode to the work piece to redirect part of the current away from the part to be plated to achieve a desired property, i.e., frequently a desired thickness profile at or near edges of parts.

As used herein "string of cells" means several individual plating cells are electrically connected in a series string by connecting the anode of one cell to the cathode of the following cell, the anode of the following cell is connected to the cathode of the next cell and so forth so that the sum of the individual cell voltages of all the cells connected in series is equal to the applied string voltage.

As used herein "shunt currents" refers to "leakage currents" which develop between working electrodes, i.e. the electrodes where the desired electrochemical reaction takes place, located in different electroplating zones/cells when said electrodes are immersed in a common electrolyte. In the case of a plurality of electrochemical cells which share a common electrolyte, the electrolyte serves as ionic conductor through which shunt currents flow between electrodes located in different cells. Such shunt currents "short-circuit" cells through the common electrolyte and, if not minimized, i.e., by maximizing the ionic resistance between adjacent cells, can prevent the effective and efficient operation of a set of cells and negate control over the plating current flow and the resulting plating weights. Shunt currents can also flow under open circuit conditions, when no external power is provided to or drawn from the cells and can result in uneven and/or undesired plating of electrodes as well as corrosion reactions. To minimize shunt currents between electrodes in different cells, electrolytes must be conducted to, through and from the cells by providing separate or tortuous electrolyte pathways to each cell in order to increase the ionic resistance between interconnected cells thereby minimizing the flow of shunt currents.

As used herein "synchronizing" power supplies means that all power supplies used to supply current to parts or series strings of parts are controlled, i.e., by a central control unit, to ensure that currents supplied to all cells at all times are similar to equal, i.e., in the case where a stepped DC current profile is used, the current is stepped from one level to the next at the same time by "synchronized power supplies" and in the case of pulse electrodeposition, the timing and height of on-pulses and reverse pulses, as well as the off times, are similar to equal at all times during the plating cycle. Synchronizing power supplies ensures that the current ramps up or declines simultaneously in all cells and, in case of pulsing, on times, off times and reverse times are synchronized to minimize electrode potential/cell voltage differences between cells and the generation of "shunt currents".

As used herein "parallel plating" means that one or more anodes in a plating cell holding the electrolyte are electrically connected with each other, two or more cathodes/work pieces/parts to be plated are electrically connected with each other and a power supply is used with one lead attached to supply power to all parallel connected anodes and the other power supply lead is attached to all parallel connected parts submersed in the electrolyte. Parallel connected cells and/or parallel connected parts share the same applied voltage; the actual cell or part current and coulombs per part can vary depending on a number of cell variables.

As used herein "series plating" means that one lead of the power supply is electrically connected to an anode in one cell, the cathode of said cell is electrically connected to the anode in another cell, the cathode in that other cell is connected to an anode in yet another cell and so forth until the last cathode is connected to the other lead of the supply power to close the electrical circuit. "Series plating" as defined herein also involves all electrodes being submersed in a common electrolyte. If no shunt currents exist, series connected cells all share the same current and coulombs, the cell voltage, however, may vary from cell to cell depending on a number of cell variables. The sum of all individual cell voltages connected in series is equal to the total applied voltage required to maintain the desired current, while the current flowing through each cell remains the same. "Series plating" is achieved by a "series connection" of the appropriate electroplating zones/cells.

As the weight of a coating is controlled by the current multiplied by the plating time (the "charge" measured in coulombs) and the efficiency of the reaction, consistent weights can best be achieved by plating parts with a dedicated power supply for each plating cell or by using one power supply and connecting all cells in a series arrangement. This is always achieved if each plating cell is totally independent and contains its own electrolyte, i.e., electrolyte is not shared by the individual cells. If plating cells share a common electrolyte, "shunt currents" are formed between adjacent cells and the coulombs directed to each cathode/work piece can no longer be precisely controlled. Conditions are complicated further if a two or more cells sharing a common electrolyte are connected in series to form a "string of cells" and the multi-compartment plating system also contains a number of "strings of cells" operated at the same time.

In summary, the invention teaches the simultaneous plating of multiple parts/workpieces in a multi-compartment plating cell using a common electrolyte with tight part thickness profile and weight tolerances by employing series plating and minimizing shunt current effects at maximum applied voltages ($V_{max}$) of up to 50V and achieving and maintaining the desired excellent part weight and thickness consistency. To achieve the desired part consistency the plating parameters in each cell including average current density $I_{average}$, peak current density $I_{peak}$, reverse (or anodic) current density $I_{anodic}$, on time, off time, anodic time (also referred to as reverse pulse on time), frequency, duty cycle, work piece rotation rate, agitation and flow rate, shielding, temperature, pH, bath (electrolyte) composition and particulate content in the electrolyte and overall plating time, are kept the same in all plating cells. Specifically, as will be illustrated, selected electrical parameters including the on, off and reverse times as well as the peak forward and reverse current must be synchronized between individual series strings. This is achieved by controlling all power supplies from a central computer and imprinting identical plating schedules on all strings and initiating and terminating the plating of all strings simultaneously. If all these conditions are maintained, the resulting deposit properties of plated parts, regardless of the cell position they are plated in or formed in, including grain size, hardness, yield strength, Young's modulus, resilience, elastic limit, ductility, internal and residual stress, stiffness, chemical composition, thermal expansion, electrical conductivity, magnetic coercive force, thickness and corrosion resistance, are kept essentially the same on all parts. The teachings provided are also illustrated in the working examples below.

In the case of metal matrix composites (MMCs) the desired volume particulate content in the metallic layer is obtained by inert material additions to the electrolyte. Minimum electrochemically inert particulate concentrations suspended in the bath (electrolyte) can be, for example, 0%, 5% or 10% by volume (vol %). As only particulate suspended in the electrolyte and contacting the cathode will be incorporated into the deposit, agitation rate and flow direction can be used as suitable parameters to adjust the particulate content in the bath (electrolyte) and therefore in the deposit. Maximum electrochemically inert particulate concentration suspended in the bath (electrolyte) can be, for example, 50, 75 or 95 vol % to affect a particulate content in the deposit ranging from 0 to 95% by volume. The higher the particulate contents in the electrolyte between anode and cathode, the higher the ionic resistance and the higher the cell voltage required to pass the desired current.

In the case of metal matrix composites, particulate particle size, particulate shape and particulate chemistry are adjusted by inert material additions to the electrolyte.

Selecting the appropriate average cathodic current density and the peak forward current density and peak reverse current density enables achieving the appropriate microstructure (average grain size or amorphous deposit), as well as alloy and metal matrix composition. Increasing average and peak forward current densities typically cause a decrease in grain size.

Adjusting the forward pulse on time, off time and anodic time (reverse pulse on time) can be used to vary the grain size, amount of alloy and metal matrix in a deposit. Increasing the on time usually increases grain size, increasing the off time usually results in decreasing grain size and increasing the anodic time usually increases grain size.

Duty cycle, cathode rotation speed, bath composition, pH and agitation rate can be suitably adjusted to achieve the desired grain size, alloy and metal matrix composition.

In summary, suitable electrodeposit properties can be obtained by suitably adjusting electrodeposition parameters (conditions) during the course of electrodeposition to produce desired thickness profiles and material properties to satisfy requirements for many modem components.

DETAILED DESCRIPTION

Figure 1:
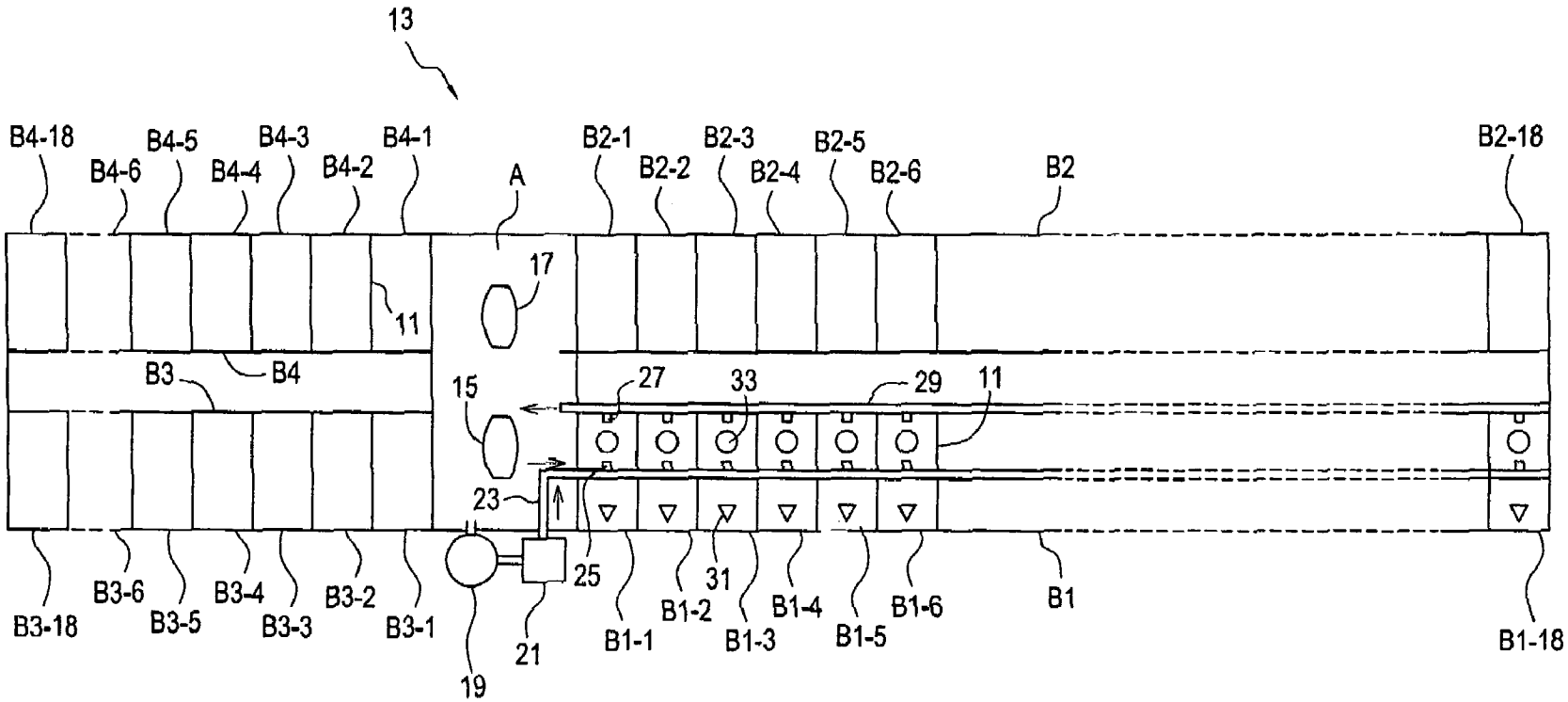
FIG. 1 depicts a cutaway top view of a multi-cell compartment.

As indicated above apparatus for the invention includes a plurality of plating cells electrically connected in series employing one power supply for each at last two plating cells.

Each plating cell constitutes an electrodepositing zone and has one or more anodes and one or more cathodes and contains an aqueous electrolyte bath containing ions of metallic material to be deposited. The cathode(s) and anode(s) are connected to a source of D.C. or pulsing current which is provided by a suitable power supply. Electrodeposition occurs on the cathode.

Each plating tank or plating cell is equipped with a fluid circulation system.

The anode can be dimensionally stable, e.g. of platinum or graphite, or can be a soluble anode that serves as a source of material to be deposited.

In the case of a free-standing deposit, the cathode is fabricated from a material that facilitates deposit stripping, e.g. titanium and graphite, and can be reusable providing for a temporary substrate.

In the case of deposit as a layer or coating, the cathode is metal, suitably metalized plastic (polymer) or other material as described and is therefore used as a permanent substrate.

The process of the invention comprises the steps of providing a multi-cell, and optionally a multi-compartment, plating system containing a common (shared) electrolyte. For example, compartments are subdivided into individual plating cells. Each plating cell contains two working electrodes, namely an anode and a cathode, and adjacent plating cells are separated from each other by a divider wall to reduce shunt currents. The plating system includes an electrolyte circulation system, i.e., advantageously the electrolyte is pumped from a central electrolyte well through suitable piping into each plating cell. Care is taken, e.g., through the use of educators, that the electrolyte volume and the electrolyte flow speed is kept uniform across all cells. Electrolyte return flow can be provided through overflow outlets and manifolding preferably using an approach where the fluid flow is interrupted into drops to disrupt the ionic continuity of the electrolyte flow thereby further minimizing effects of shunt currents. The electrolyte circulation loop preferably also contains a single filter or multiple suitable filters to remove impurities and dirt. A workpiece is loaded into each cell, i.e. using a suitable loading tool to enable simultaneous insertion of multiple work pieces into multiple cells at a time. The workpieces to be coated are either inherently conductive or suitably rendered conductive. Electrical connections are provided to a string of cathodes/work pieces to be plated and to an appropriate number of anodes, and electroplating of the desired metallic material with a predetermined microstructure and composition on at least part of the external surface of all cathodes takes place. Parts to be plated simultaneously in series strings using direct current or pulsed current, as described in greater detail above or below, produce electrodeposits with consistent properties. Plating cell designs minimizing shunt currents are used and all power supplies are suitably synchronized to maintain uniform part weights, thickness profiles and microstructures meeting tight production specifications.

Ranges for cathodic current density, forward pulse on time, off time, reverse (anodic) pulse on time, peak forward current density, peak reverse current density, duty cycle, electrode rotation speed, bath (electrolyte) temperature, bath (electrolyte) composition, bath (electrolyte) agitation rate, shielding and inert additions are given above.

Typical electroplating cell voltages range from 2 to 30V per cell and numerous cells are electrically connected in series. For safety reasons the overall string voltages are preferably kept at $\leqq$50 Volts. Typically, each three cells are associated in a string with the cells in a string being electrically interconnected in series with each string being supplemented with power from a single power source.

We turn now in more detail to the process parameters.

All electrical parameters for a string, i.e. cathodic current density, forward pulse on time, off time, reverse pulse on time, peak forward current density, peak reverse current density, duty cycle and frequency are adjusted using the power supply for the string.

Where electrode rotation is required, rotation is achieved, e.g., by using a fixer or a variable speed motor coupled to the cathode to enable its rotation. One motor is typically used to rotate a number of workpieces by employing gear or belt drives.

The bath (electrolyte) temperature can be controlled by one or several heaters, i.e., immersion heaters. In the case of larger systems, resistance heating during plating requires insertion of a chiller to keep the electrolyte temperature from rising beyond a set maximum temperature. Heaters and chillers are preferably located in the central electrolyte well.

Bath (electrolyte) composition can be maintained by one or more steps comprising using a metering pump to add solution; adding, removing or modifying selected components using a circulation/bypass loop; using soluble anode with anodic current control to supply ionic species; using soluble anode and a dimensionally stable anode; using two or more soluble anodes of different composition with individual current control in the case of alloy deposit; air agitation to selectively oxidize bath component(s); agitation to control particulate contents; and mixing to effect local ion concentration(s) at the cathode surface. The bath contains metal ions to be plated in a concentration ranging, for example, from 0.01 mole per liter to 20 moles per liter.

The bath (electrolyte) agitation rate in each cell is controlled by suitably adjusting pump speed, flow direction and the use of eductors.

The bath (electrolyte) pH is controlled by addition of acid or base, as appropriate to lower or raise the level as appropriate to maintain the desired pH range.

Various property parameters of the electrodeposited layers are listed below.

Minimum thickness of the electrodeposit [μm]: 20; 30; 50

Maximum thickness of the electrodeposit [mm]: 5; 25; 50;

Minimum thickness of a fine-grained sublayer [nm]: 1.5; 25; 50

Maximum thickness of a fine-grained sublayer [μm]: 50, 250, 500

Minimum average grain size [nm]: 2; 5; amorphous (i.e. no grains but glassy structures)

Maximum average grain size [nm]: 250; 500; 1,000; 5,000; 10,000; 250,000

Minimum stress of the sublayer or the electrodeposited layer (in tension or compression) [ksi]: 0; 1; 5

Maximum stress of the sublayer or the electrodeposited layer (in tension or compression) [ksi]: 25; 50; 200

Minimum ductility of the electrodeposit [% elongation in tension]: 0.5; 1; 2.5

Maximum ductility of the electrodeposit [% elongation in tension]: 5; 15; 30

Hardness [VHN]: 50-2,000

Yield strength [MPa]: 100-3,000

Young's modulus [MPa]; 50-300

Resilience [MPa]: 0.25-25 elastic range [%]: 0.25-2.5, coefficient of thermal expansion [ppm/K]: 0-50 coefficient of friction: 0.01-1 electrical resistivity [micro Ohm-cm]: 1-100

Deposition rates used are at least 0.001 mm/hr, preferably at least 0.01 mm/hr and more preferably at least 0.10 mm/hr.

As used herein, the term "deposit direction" means the direction of current flow between anode and cathode in the electrodepositing cell and the resulting build-up in the electrodeposited layer on the cathode, and if the cathode is a flat plate, the direction of deposit is perpendicular to the cathode.

We turn now to the metallic materials that are electrodeposited.

In one case the metallic material is a metal selected from the group consisting of Ag, Au, Cu, Co, Cr, Mo, Ni, Sn, Fe, Pd, Pb, Pt, Rh, Ru and Zn.

In another case the metallic material is an alloy of one or more elements selected from the group consisting of Ag, Au, Cu, Co, Cr, Mo, Ni, Sn, Fe, Pd, Pb, Pt, Rh, Ru and Zn and optionally one or more elements selected from the group consisting of B, P, C, Mo, S and W.

In still another case, the metallic material contains:

(i) one or more metals selected from the group consisting of Ag, Au, Cu, Co, Cr, Mo, Ni, Sn, Fe, Pd, Pb, Pt, Rh, Ru and Zn;

(ii) at least one element selected from the group consisting of C, O and S; and (iii) optionally at least one or more elements selected from the group consisting of B, P, Mo and W. Group (ii) elements are provided in the range of 10 ppm to 5%, group (iii) elements in the range of 500 ppm to 25%, the balance being group (i) elements which typically range from 75% to 99.9%.

We turn to a case where the electrodeposit is a metallic material containing particulates, i.e., of metal matrix composite. The metallic material is as described above. Suitable particulate additives for preparing metal matrix composites include metal (Ag, Al, Cu, In, Mg, Si, Sn, Pt, Ti, V, W, Zn) powders; metal alloy powders; metal oxide powders of Al, Co, Cu, In, Mg, Ni, Si, Sn, V and Zn; nitrides of Al, B and Si; carbon (graphite powder, carbon powder, graphite fibers, Buckminster fullerenes, carbon nanotubes, diamond); carbides of B, Cr, Bi, Si, W; glass, organic materials including polymers such as polytetrafluoroethylene, polyethylene, polypropylene, acrylonitrile-butadiene-styrene copolymer, polyvinyl chloride, epoxy resins. The particulate average particle size is typically below 10,000 nm (10 μm), more preferably, below 500 μm, still more preferably below 100 μm.

In the case where product contains particulates, the particulates are part of the plating bath and are deposited with the metallic material. In other words, metal matrix composites are electrodeposited. The particulate components do not participate in electrochemical reduction as is the case with the metallic components and simply get incorporated into the electrodeposited deposit by inclusion. The volume content of particulates can be suitably adjusted by adding particulates to the bath to affect the incorporation of said particulate into the electrodeposit. Agitation rates and/or flow patterns can be used to control the amount of particulates suspended in the bath, with higher agitation rates generally resulting in increased particulate contents in the deposits.

We turn now to where the electrodeposit is for a free-standing form. The free-standing form is stripped from strippable cathode such as a titanium cathode as described above. The utility of free-standing form is, for example, for electroformed articles such as foils, plates, tubes and complex shaped articles.

We turn now to where the electrodeposit is as a layer or coating on a substrate. In this case the permanent substrate (substrate stays with the electrodeposit to form an article containing the electrodeposit and substrate, rather than being a strippable substrate) is the cathode.

Suitable permanent substrates include a variety of metal substrates (e.g. all steels; metals and alloys of Al, Cu, Co, Ni, Fe, Mo, Pt, Ti, W and Zr), carbon-based materials (e.g. carbon, diamond, graphite, graphite fibers and carbon nanotubes) substrates; and polymer substrates. Suitable polymeric materials for polymeric substrates include filled epoxy resin composite material, unfilled epoxy resin, polyamide, mineral filled polyamide resin composites, polyvinyl chloride (PVC), thermoplastic polyolefins (TPOs), polytetrafluoroethylene (PTFE), polycarbonate and acrylonitrile-butadiene-styrene (ABS). Suitable fillers for the filled epoxy resin composites include glass fibers, carbon, carbon nanotubes, graphite, graphite fibers, metals, metal alloys, ceramics and mineral fillers such as talc, calcium silicate, silica, calcium carbonate, alumina, titanium dioxide, ferrite, and mixed silicates (e.g. bentonite or pumice), and are present in amount up to 70% by weight. Mineral-filled polyamide resin contains powdered (e.g. 0.2-20 microns) mineral fillers such as talc, calcium silicate, silica, calcium carbonate, alumina, titanium dioxide, ferrite and mixed silicates (e.g. bentonite or pumice) and mineral contents of up to about 40% by weight and provides high strength at relatively low cost.

Where the substrate to be provided with an electrodeposited layer or coating is poorly conductive or nonconductive, it can be metalized to render it sufficiently conductive for plating, e.g. by applying a thin layer of conductive material, e.g. by electroless deposition, PVD, CVD or by applying an electrically conductive paint. Thus the subject invention encompasses providing layer or coating to virtually any substrate material.

An electrodeposited coating layer can be suitably exposed to a finishing treatment, which can include, among others, electroplating, i.e., chromium plating and applying a polymeric material, i.e., a paint or adhesive.

We turn now to benefits of and utility for the invention.

It is noted that the invention requires a multi-cell plating system subdivided into multiple individual plating cells containing a shared electrolyte with multiple parts plated simultaneously in a series plating system with a single power source powering a plurality of plating cells with excellent metallic layer thickness profile and weight consistency. Benefits of this include reducing the operating cost of the plating tank, minimizing the plating system floor space and reducing the capital equipment cost of the plating system and the power supplies as each power supply provides power to several cells in a series connection. Loading and unloading of parts is typically also done by the employ of suitable tools, each tool holding multiple parts to be plated.

Electrodeposited metallic materials containing at least in part a fine-grained, a coarse grained or an amorphous microstructure provide the desired overall mechanical properties. Compared to conventionally coarse-grained (average grain size >20 microns) deposits, fine-grained deposits of the same chemistry provide high hardness (high wear resistance), higher yield strength, and tensile strength. High ductility and improved corrosion performance is usually provided by coarse-grained metallic deposits. Amorphous deposits provide high hardness, high wear resistance and they lack intergranular corrosion resistance and are characterized by much reduced ductility.

Numerous applications benefit from the multi-cell plating system employing plating cells electrically connected in series and a single power source for each string of cells. As an example, articles such as metal plated carbon fiber/epoxy rollers, golf shafts, baseball bats, rods, tubes etc requiring a uniform thickness across the cross section, a predetermined thickness profile along the length axis, uniform weight of the parts and metallic layer properties including a high resilience, high outer surface hardness to reduce wear, are produced economically in high volume in such a multi-cell plating system.

Parts made from or coated with electrodeposited metallic materials, which are in whole or in part fine-grained, coarse grained and/or amorphous, made by the invention as disclosed herein, are particularly useful for structural components requiring great dimensional stability over a wide operating temperature range and are not prone to cracking, spalling or delamination. The electrodeposition process herein is particularly suitable for synthesizing stiff, strong, tough, ductile, lightweight, wear and corrosion resistant free-standing parts, coatings and layers.

In a number of applications, e.g. the aerospace field, the dimensional stability of articles with critical dimensions which do not change over the operating temperature range, are vital. Among metals and alloys selected, nickel-iron alloys (e.g. Invar®, an alloy containing about 36% by weight of nickel and 64% by weight of iron) provide unusually low coefficients of thermal expansion (CTE). This invention enables the convenient and consistent fabrication of articles economically in high volume using CTE matching by providing the added strength through a grain refinement.

Articles made using the multi-cell electroplating system described find use in a variety of applications requiring durable, light-weight, high-strength layers or coatings that provide improved reliability, durability and performance characteristics. Applications include automotive components, aerospace parts, defense parts, consumer products, medical components and sporting goods. Suitable industrial parts include, among others, rods, rolls, tubes or shafts used, e.g., in industrial applications such as in continuous-process manufacturing equipment, hydraulic equipment and the like; sporting goods such as ski and hiking poles, fishing rods, golf club shafts, hockey sticks, lacrosse sticks, baseball/softball bats, bicycle frames; plates such as golf club head face plates; as well as complex shapes such as sports racquets (tennis, racquetball, squash and the like), golf club heads, automotive parts such as grill-guards; running boards; spoilers; muffler tips, wheels, vehicle frames, structural brackets, and carbon fiber composite (CFC) molds. Consumer products include electronic appliances such as walkman, discman, MP3 players, cell phones and blackberries, cameras and other image recording devices as well as TVs. Parts are at least partially coated on or within their structure to contain variable property metallic materials by the invention herein. For example, electrodepositing can be onto a substrate of an orthopedic prosthesis, gun barrel, mold, sporting good or automotive component.

The examples herein illustrate the following plating issues: parallel plating of multiple parts (Prior Art Example 1) with fine-grained Ni or Ni—Fe, polarization curves for anodic Ni dissolution and cathodic Ni deposition in different plating cells and using various parts (Background Examples 1, 2 and 3), comparison of coating weight consistency between a single cell plating one part at a time and a multi-cell plating system plating 18 parts simultaneously. (Working Example I), series plating comparison between 3-part and 4-part strings (Working Example II), thickness distribution comparison between a single cell plating one part at a time and a multi-cell plating system plating 18 parts simultaneously (Working Example III), statistical part thickness and part weight analysis in a multi-cell plating system plating 18 parts simultaneously (Working Example IV), statistical part weight analysis of several runs performed in a multi-cell plating system plating 18 parts simultaneously (Working Example V), statistical part thickness and part weight analysis of several runs performed in a multi-cell plating system plating 36 parts simultaneously (Working Example VI), relationship between part weight variation and cell-to-cell voltage variation in a multi-cell system plating system (Working Example VII).

In a use of the invention herein there is provided crystalline and/or amorphous metallic layers to provide benefits of overall mechanical and chemical properties which are consistent from part to part.

By one case the invention herein metallic coating can be applied to a part made substantially of the same chemistry to achieve excellent metallurgical bonding between a coating or layer and a substrate and also refined grain size toward outer surface to enhance a physical property selected from the group of lubricity, hardness, strength toughness and wear resistance.

In one alternative, the invention herein provides articles with varied grain sizes, internal stresses and/or brittleness that do not crack and/or delaminate from a permanent substrate during preparation, temperature cycling or regular use.

In one alternative, the invention herein provides articles with fine-grained or coarse grained grain sizes that are strong, tough, hard and wear and abrasion resistant as well as light-weight.

In an alternative, the invention herein provides metal, metal alloy or metal matrix composite coatings or layers with fine-grained or coarse-grained grain sizes and/or amorphous microstructures) to enhance at least one property selected from the group consisting of internal stress, strength, hardness, toughness, ductility, coefficient of friction, scratch resistance and wear resistance due to suitably selecting the appropriate metallic layer microstructure.

In an alternative, the invention herein provides articles and coatings with particulate matter therein to effect a deposition of a metal matrix composite to achieve metallic layers containing a suitable volume fraction of particulates to, e.g., enhance wear performance.

In another alternative, the invention is used to provide metallic coatings of metal and/or metal alloy and/or metal matrix composite on the inside or outside of a tube, e.g., gun barrels using a nanocrystalline-NiW-diamond composite or nanocrystalline CoP-diamond metal matrix composite to improve resistance to cracking, spalling and erosive wear, particularly near the chamber as part of a variable property layer that remains hard, wear resistant and of maximum obtainable thermal stability, throughout the service life, along with a thermal shock response that is close to that of the steel substrate barrel inner surface (matching coefficient of thermal expansion, Young's modulus, strength and ductility).

In an alternative, the invention herein provides metallic coatings which are lubricious for use as sliding surfaces of selected parts, i.e. to hydraulic components or sliding mechanisms of parts such as actions of automated and semi-automated rifles with metal, alloy or metal matrix grades, e.g. metal matrix composites with nanocrystalline NiW layers containing hexagonal BN particulates or nanocrystalline-CoP-layers containing hexagonal BN particulate inclusions also containing diamond particulates, to improve the coefficient of friction of said outer surface as well as wear performance and longevity of said outer surface.

The instant invention provides for metallic coatings, layers or free-standing articles for applications including, for example, sporting goods (golf clubs and shafts, hockey sticks, baseball bats, tennis racquets, skiing and snowboarding equipment, boards and coatings on complex shapes, e.g. skate boards), medical devices (surgery tools, stents, orthopedic prosthesis parts and hp implants), automotive and aerospace applications, consumer products (electronic equipment, phones, toys, appliances, tools), commercial parts (gun barrels, molds).

In a subsequent step, parts containing the metallic coatings or layers can be subjected to other finishing operations as required including, but not limited to, polishing, waxing, painting, plating i.e. Cr-plating.

According to one alternative of this invention, patches or sections can be formed on selected areas of articles, without the need to coat the entire article, e.g., utilizing selective deposition techniques.

We turn now to cases where each electrodeposit of a plurality is provided with the same variable property in every one of the simultaneously plated parts, in the deposit direction and/or within (i.e. along the width or length of) the deposit, i.e., electrodepositing parameters for each cell are modulated the same to cause variation in a deposit on a substrate by more than 10%.

In this case the properties of the electrodeposit are changed by modulating the deposition parameters (i.e. the electrical plating conditions) to vary grain size and therefore properties influenced by the grain size including, but not limited to, hardness, yield strength and resilience, the same in all the parts. This is described in U.S. application Ser. No. 12/003,224,filed 20 Dec. 2007,for single cell electrodeposit.

Grading in the deposition direction or multidimensional grading is particularly suitable if, an article without a fine grained layer exhibits significant internal stress and/or brittleness and when metallic material applied as a coating or layer cracks and/or delaminates from a substrate and in the case of free standing structures which crack and/or disintegrate upon forming or deforming in use (i.e. upon bending or when under tension).

Grading in the deposition direction or multidimensional grading can be carried out, for example, in each electrolytic cell as previously described equipped with a recirculation loop with means to enable variation of flow rate so as to provide different bath composition as a function of distance from the center of the deposit thereby grading throughout a coating grade. Other ways of carrying this out include anode shielding, and/or placing one of the several anodes in closer proximity to an area to be varied in property.

Turning again to where operating parameters are modulated to produce microstructures with different grain sizes, this is illustrated for nickel in Table 1 below.

TABLE 1

Variation in Properties of Nickel Due to Variation in Grain Size.

| | 20 nm grain size | 100 nm grain-size | 30 micron grain size |
|---|---|---|---|
| Hardness [VHN] | 600 | 325 | 120 |
| Elongation in tension [%] | 2 | 16.7 | 30 |
| Yield Strength [MPa] | 850 | 670 | 150 |
| Young's Modulus [GPA] | 150 | 200 | 200 |
| Modulus of Resilience [GPA] | 2.4 | 1.1 | 0.06 |

Further explanation of how changing grain size of nickel affects physical properties follows: the hardness increases from 120 VHN (for conventional grain sizes greater than 5 microns) to 325 VHN (grain size of 100 nm) and ultimately to 600 VHN (grain size 20 nm) and the yield strength from 150 MPa to 850 MPa.

As highlighted, the principal subject of the invention is the employ of a multi-cell electroplating system using a common electrolyte and power from a single source for multiple cells for electroplating a number of parts simultaneously in a series arrangement with the objective to consistently achieve substantially uniform plating thickness profiles and plating weights. The system includes an electroplating solution circulated throughout the multi-cell plating tank containing at least two cells, preferably with each power source supplying at least two cells. The following description is based on a plating system containing a central electrolyte well and being readily accessible for performing bath management functions.

Figure 1A:
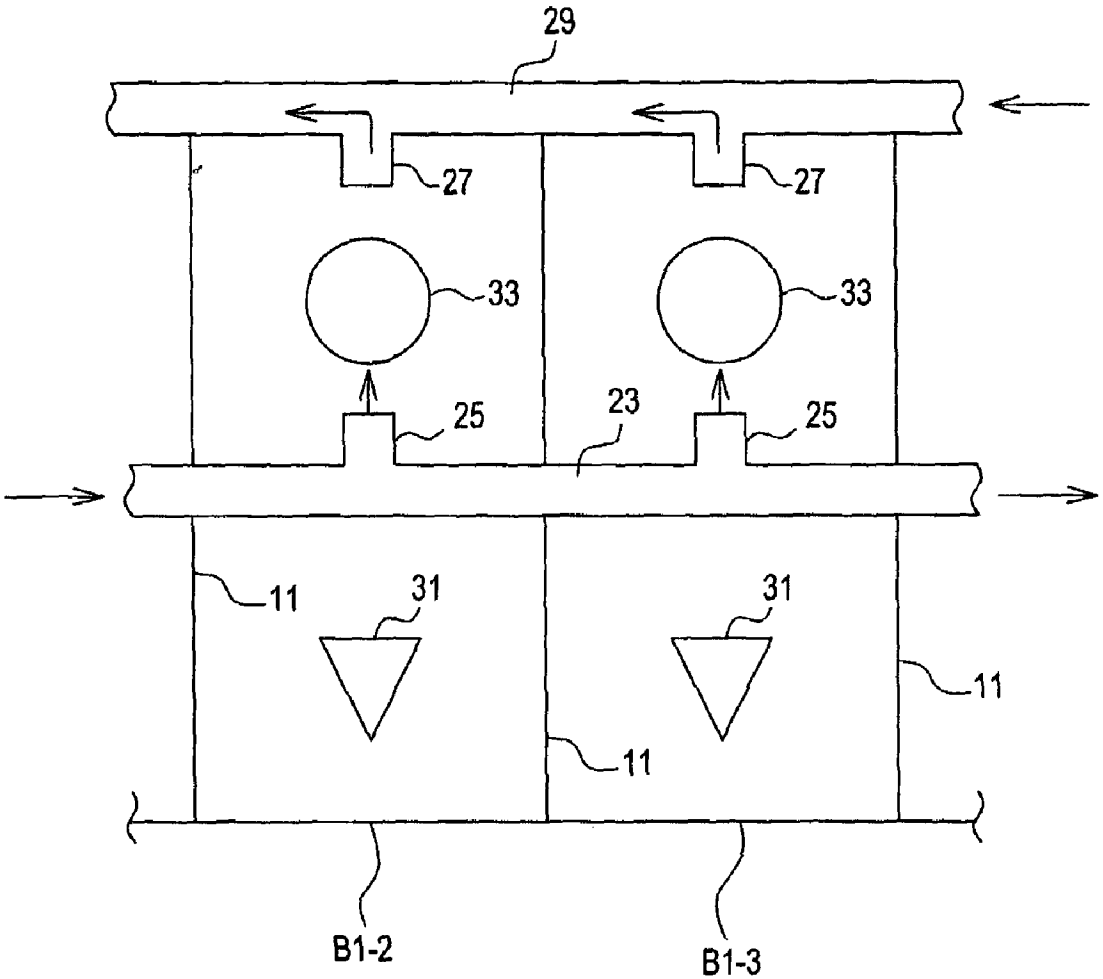
FIG. 1A is an enlarged view of two adjacent cells of FIG. 1.
Figure 2:
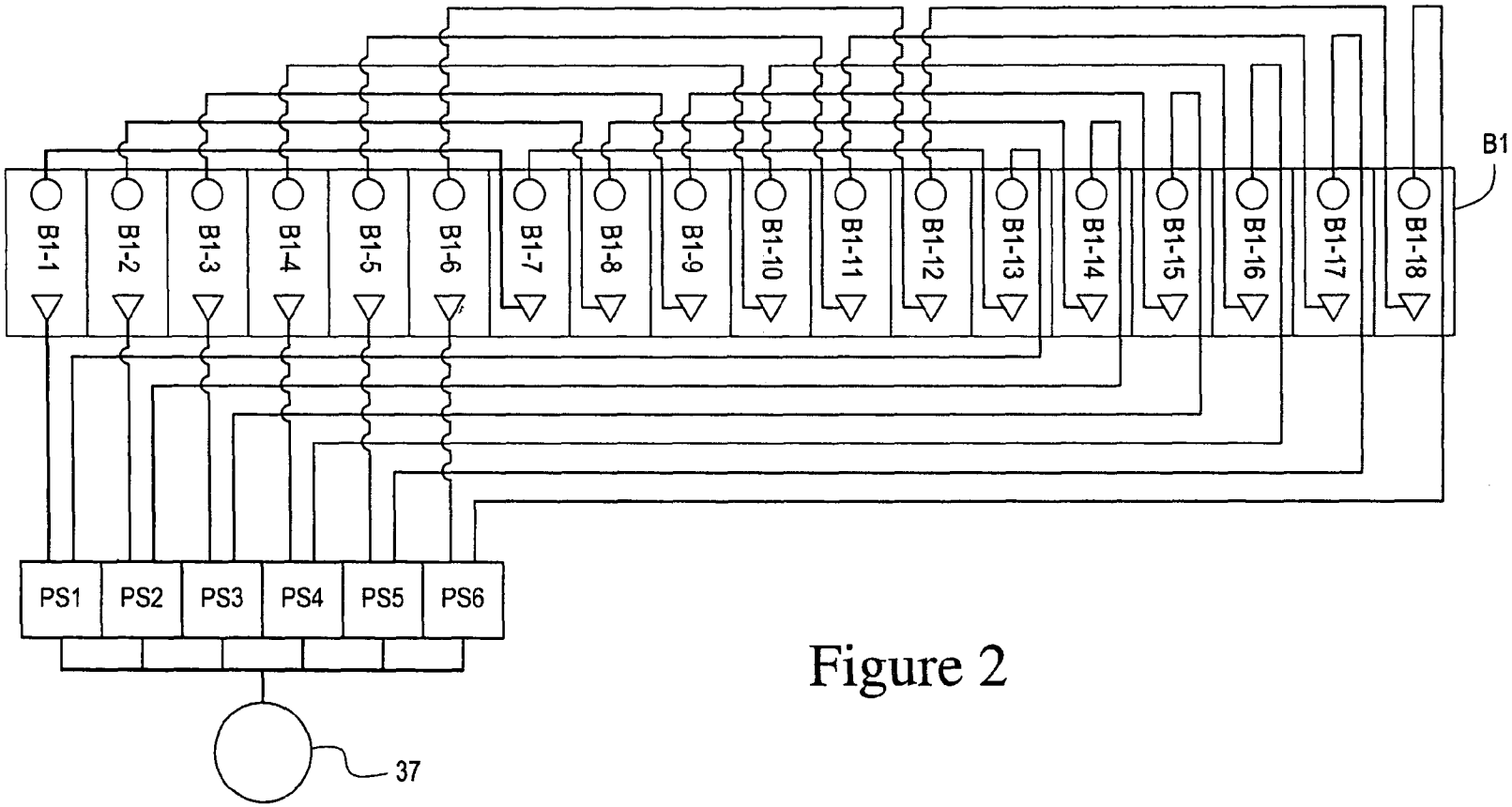
FIG. 2 depicts the electrical wiring schematic for simultaneously plating 18 parts in an 18 cell multi-cell compartment, i.e. compartment B1 of FIG. 1, configured to simultaneously plate six strings, each string containing three parts in a series configuration.

A preferred multi-cell plating system and operation thereof is now described in conjunction with FIGS. 1, 1A and 2.

With continuing reference to FIGS. 1 and 1A, a multi-cell plating system 13 is depicted. In system 13, four compartments, B1, B2, B3 and B4, extend from a central electrolyte well A along the length of the plating system. Each compartment B1, B2, B3 and B4 is subdivided by dividers/spacers 11 into 18 individual plating cells. The cells for B1 are denoted B1-1 to B1-18. The cells for B2 are denoted B2-1 to B2-18. The cells for B3 are denoted B3-1 to B3-18. The cells for B4 are denoted B4-1 to B4-18. Some cells are not depicted and are represented by break lines. Only cells B1-1, B1'-2, B1-3, B1-4, B1-5, B1-6 and B1-6 and 18 are depicted with details (anodes, cathode workpieces, electrolyte inlet lines, and electrolyte outlet lines) which are described later. Manifolds for electrolyte distribution and return are depicted for B1 and will be described later. Inlet and outlet manifolds for B2, B3 and B4 are omitted from depiction in FIG. 1 to simplify the drawing. Division of each of the compartments into 18 cells enables the simultaneous plating of up to 72 parts at one time. Depending on needs, the number of compositions can be increased or decreased to one or more compartments, as required. Similarly, the number of cells per compartment can be suitably increased or decreased (to no less than two cells) to meet part production requirements.

The multi-cell plating system 13 has a central well A for holding electrolyte for operation is filled with an electrolyte solution containing ions of the metallic material to be deposited (referred to as an electrolyte bath), containing heater(s) 15, chillers 17 and temperature sensors (not depicted). Metering pumps (not depicted) suitably dispense chemicals to maintain the electrolyte bath composition and pH with set specification. Electrolyte is drawn from well A by pump 19 and is pumped through a filter 21 to remove impurities and from there to feed manifold 23 into one of the 18 multi-cell compartments extending from the electrolyte wells to the opposite end of the compartment.

To supply electrolyte to each compartment suitable electrolyte feed piping is provided, i.e., along the floor of the compartments (reference numeral 23 for compartment B1) with nozzles (25) at periodic intervals to direct electrolyte flow into each of the plating cells with the flow directed upwards, or as desired/required. Electrolyte enters each cell via a nozzle (eductor) (25) from the pipe (23). The electrolyte supply manifold is sized appropriately to maintain sufficient pressure to ensure that the electrolyte flow into each cell is similar. At predetermined locations in each cell height-adjustable openings (27) are provided to effect electrolyte back flow via a return manifold (29) which discharges the electrolyte back into the central well (A) completing the electrolyte circulation loop. In the system illustrated, the backflow is directed through the container wall to a manifold system which collects the electrolyte from each cell and re-circulates it to the central electrolyte well. Care is taken in the design of the electrolyte circulation system to minimize shunt currents between cells and to enable the plating of uniform parts. The electrolyte circulation hardware is replicated for all other compartments (not shown in FIG. 1). An enlarged view showing elements 23, 25, 27, 29, 31 and 33 in adjacent cells B1-2 and B1-3 is provided in FIG. 1A.

Although electrolyte solution is permitted to flow between cells and all cells share a common electrolyte, by suitably sizing the plumbing and inserting divider plates (11) between cells as described, the ionic resistance between an anode (31) (see FIG. 1A) and cathode (workpiece 33) in cell B1-2 or in cell B1-3 is much lower than the ionic resistance between anodes and cathodes across adjacent cells, e.g., between anode 31 in cell B1-2 and cathode 33 in cell B1-3 and between anode 31 in B1-3 and cathode 33 in B1-2. The ionic resistance between anodes and cathodes increases as the physical distance increases; i.e., the most notable effects are between anodes and cathodes in directly adjacent cells, followed by anodes and cathodes in cells with one cell in between, followed by anodes and cathodes in cells with two cells in between and so forth. Thus, stray currents between individual cells are reduced as outlined below.

As shown in FIG. 1A, each plating cell contains an anode (31), preferably a Ti anode basket capable of receiving the soluble anode material such as Ni-rounds, and a cathode/work piece (33). If desired, anodes are suitably shielded to effect the desired thickness distribution along the length of the work piece. The cathode arrangement consists of several tools (one for each compartment); each tool contains 18 cathode fixtures suitably spaced apart. Suitable cathode fixtures include feeder rods which, if desired, can be connected to a motor to affect their rotation at a predetermined speed. The workpieces to be plated, i.e., in the case of substrate tubes, are suitably mounted on the cathode feeder rods. Once loaded the cathode tools containing the 18 substrates each are lifted by overhead cranes and lowered into the compartments to insert one cathode/work piece into each cell. The tools also contain part of the wiring and matching contacts are provided on the multi-cell plating system and the tooling to appropriately close the electrical circuit.

In operation, initially the tool is populated with workpieces, i.e., tubes loaded onto the respective current feeders, in a loading/unloading area. The tool populated with workpieces is thereafter lifted and after optional metallizing and/or cleaning steps, is eventually positioned above a plating compartment and lowered/inserted, i.e., with an automated crane (not shown). Once loaded, the cathode tooling suitably rests on its base using locator pins. Appropriate positioning of the cathode tool ensures that all workpieces are secured in their respective plating cell position. Contacts on the tools and plating system tank lip close the contact for the rotation system and as soon as the tool rests in its appropriate place, all cathodes/workpieces can be rotated, if desired. Thereafter, plating is initiated by supplying electrical power to all work pieces from the external power supplies (not shown) via suitable wiring (not shown) to cathodes, anodes and, where applicable, thieving electrodes and the electroplating process commences. The current supplied to thieving electrode can be adjusted by appropriately designing/sizing the thieving electrode to compensate for edge effects and achieve predetermined thickness profiles. After plating has been completed the cathode tooling assembly is removed from the compartment, processed through appropriate washing stations, and finally returned to the loading/unloading area.

In the case of plating three parts per string, six power supply modules are appropriately used to power each 18 cell compartment and electrical connections are made accordingly. FIG. 2 schematically illustrates the electrical wiring of such an 18 cell compartment (B1) consisting of 18 individual plating cells (B1-1 to B1-18), powered by six synchronized power supplies (PS-1 to PS-6). Each cell contains one anode (31) and one cathode (33). Each cathode 33 holds one work piece only. Three cells are connected in series to form a 3-part string. Series connection is achieved by connecting the positive lead of the power supply PS-1 to the anode in cell B1-1, the cathode of cell B1-1 is connected to the anode of cell B1-7, the cathode of cell B1-7 is connected to the anode of cell B1-13 and the cathode of cell B1-13 is connected to the negative terminal of the power supply, as illustrated. The same logic is repeated for the remaining strings as illustrated in FIG. 2.

The power supplies PS-1 to PS-6 are connected to a central control module (37) which regulates all electrical plating parameters including the suitable plating schedule and pulse plating regimes, if any. The central control module is used to initiate and terminate plating simultaneously in all cells by appropriately turning all power supplies on and off. The central control module also imprints the synchronized plating schedules on all power supplies and cells, including the peak current, on time, off time, reverse time and peak reverse current. The preset plating schedule can include a multi-step plating schedule to impose different grain size/hardness from the substrate base to the outer surface. The plating schedule is typically chosen to finish with the highest average current density to optimize part properties, particularly to increase the outer hardness of the deposit by suitably decreasing the grain size. The plating schedule is typically programmed to pass the desired coulombs and, once the predetermined charge is passed, the power supplies are turned off and the cathode tool is removed from the multi-cell plating system and processed through suitable washing tanks and finally the plated work pieces are removed and new substrates inserted, upon which the entire plating process is repeated.

Before proceeding with the examples the problems which the present invention is capable of solving are described hereinafter in greater detail. When multiple plating cells share a common electrolyte, ionic conductivity is provided by said electrolyte effectively connecting all anodes and cathode submersed in it. Persons skilled in the art of electrochemistry refer to this problem as shunt-currents and a number of part defects are caused by the presence of "shunt-currents". Most notably defects include unpredicted plating thickness, weights and generation of plating surface defects. The degree of defects depends on the electrolyte conductivity, the length between electrodes which affects the various resistivity paths and the applied voltage. Maximizing shunt current resisitivity paths in the electrolyte and minimizing the applied voltage minimizes shunt currents. Applying a series connection between cells raises the maximum applied voltage as each cell voltage is multiplied by the number of cells and therefore one would ordinarily not adopt a series plating configuration. On the other hand, if shunt currents can be totally avoided or minimized in a series connection, the coulombs (=A×sec) applied to each part remains identical assuring excellent deposit weight consistency. Specifically to pulse plating, as the peak current applied during the forward pulse and therefore the peak voltage is even higher than in the case of DC plating, minimizing shunt currents to effect part consistency becomes even more important.

The prior art is illustrated by Prior Art Example 1. Background is provided by Background Examples 1-3.

The invention is illustrated in Working Examples I-VII.

PRIOR ART EXAMPLE 1

Parallel Plating Cell of Multiple Parts in a Plating Cell System Using a Shared Electrolyte To illustrate the prior art of plating parts simultaneously by electrically connecting all parts in parallel and controlling the total current supplied to the plating rack known in the art as rack plating, two different parts (celluloid spheres and flat polyamide tensile coupons) were selected.

In experiment 1 ping pong balls (40 mm diameter) made of celluloid were suitably metallized with a Ni film (electroless nickel, MacDermid Inc., Denver, Colo., USA) and thereafter electroplated with a nanocrystalline nickel-iron alloy (n—Ni—20Fe) layer to an average thickness of about 185 μm in 4.5 hrs using the modified Watts nickel bath for Permalloy® illustrated in Table 2 using grain refiners, levelers, brighteners, specifically Nanoplate®-B16 and Nanoplate®-A24 (Integran Technologies Inc., Toronto, Canada). Soluble Ni rounds (Inco Ltd., Sudbury, Ontario, Canada) and soluble Fe chips (Allied Metals Corp. of Troy, Mich.) were employed as anode. Plating current was supplied by a pulse power supply (Dynatronix, Amery, Wis., USA).

TABLE 2

Electrolyte Composition, Plating Conditions and Selected Coating Properties for n-Ni—20Fe Layers.

| Bath Chemistry | |
|---|---|
| 208 | g/l $NiSO_4 \cdot 6H_2O$ |
| 36 | g/l $NiCl_2 \cdot 6H_2O$ |
| 36 | g/l $H_3BO_3$ |
| 36.8 | g/l $Na_3C_6H_5O_7$ |
| 9.6 | g/l $FeCl_2 \cdot 6H_2O$ |
| 4.2 | ml/l Nanoplate ®-B16 |
| 1.6 | g/l Nanoplate ®-A24 |

| Plating Conditions | |
|---|---|
| Electrolyte Temperature [° C.] | 60 |
| pH | 2.5 |
| Electrolyte Agitation Rate (normalized for cathode area) [ml/(min · $cm^2$)] | 50 |
| Rotation Speed [RPM] | 10 |
| Bath Flow Direction | Tangential |
| Particulate Bath Content (in suspension) | N/A |
| Anode Shielding | N/A |
| Average Current Density ($I_{avg}$) [mA/$cm^2$] | 100 |
| Forward Pulse On Time [min] | 280 |
| Off Time [ms] | N/A |
| Reverse Pulse On Time [ms] | N/A |
| Peak Reverse Current Density [mA/$cm^2$] | N/A |
| Total cycle time [ms] | N/A |
| Frequency [Hz] | 0 |
| Duty Cycle [%] | 100 |
| **Ni—20Fe Material Properties** | |
| Hardness (VHN) | 525 |
| Average Grain Size [nm] | 20 |

Table 3 illustrates the data obtained for the ball coating weights using a single cell plating tank (40 liter bath volume) and simultaneous plating of 10 balls in parallel, i.e., all 10 parts are connected to a common current feeder which is connected to the negative lead of the power supply. During the plating the balls are rotating while being submersed in the bath and the part rack rotates against the stationary anode. The average plating weight in grams, the standard deviation, the standard deviation divided by the average weight in %, the kurtosis, the highest plating weight and lowest plating weight are displayed, as is the weight variation expressed in percent from the average plating weight for three consecutive runs.

The data indicate that the weight consistency obtained varies from run to run with the standard deviation/average weight ratio ranging from 1.6% to 5.6%. The maximum weights vary between 2.1% and 5.7% from the average weight and the minimum weights between 2.6% and 8.5% from the average weight. As these runs were performed in succession and all the contacts were properly cleaned between runs better weight uniformity is achieved than in a typical production setting. As contacts also degrade/corrode with time affecting the contact resistance and thereby the local part current weight, consistencies achieved over time suffer.

TABLE 3

Position Specific Weights for Ten Ping-Pong Balls Coated With n-Ni—Fe in Parallel in a Single-Cell Plating Tank

| POSITION | RUN 1 | RUN 2 | RUN 3 |
|---|---|---|---|
| 1 | 20.19 | 20.52 | 21.38 |
| 2 | 21.03 | 19.74 | 20.91 |
| 3 | 20.62 | 20.21 | 18.81 |
| 4 | 19.93 | 20.65 | 18.95 |
| 5 | 21.02 | 19.98 | 20.94 |
| 6 | 20.99 | 20.24 | 20.34 |

TABLE 3-continued

| Position Specific Weights for Ten Ping-Pong Balls Coated With n-Ni—Fe in Parallel in a Single-Cell Plating Tank | | | |
|---|---|---|---|
| POSITION | RUN 1 | RUN 2 | RUN 3 |
| 7 | 20.51 | 20.16 | 21.32 |
| 8 | 21.54 | 20.70 | 21.35 |
| 9 | 20.86 | 20.55 | 18.50 |
| 10 | 20.61 | 19.91 | 19.75 |
| Average Weight [g] | 20.73 | 20.27 | 20.23 |
| Standard Deviation | 0.46 | 0.33 | 1.14 |
| STDEV/ Average Weight [%] | 2.23 | 1.63 | 5.62 |
| Kurtosis | 0.20 | −1.27 | −1.61 |
| Max Weight [g] (Deviation from Average [%]) | 21.54 (+3.9%) | 20.70 (+2.1%) | 21.38 (+5.7%) |
| Min Weight [g] (Deviation from Average [%]) | 19.93 (−3.9%) | 19.74 (−2.6%) | 18.50 (−8.5%) |

In experiment 2 fine-grained Ni coatings were applied to polyamide tensile coupons (63 $cm^2$ total surface area), which had been metallized using electroless Ni (MacDermid Inc., Denver, Colo., USA) as above. The electrolyte composition and the electroplating conditions used for the modified Watt's bath for n—Ni is indicated in Table 4. Soluble Ni rounds (Inco Ltd., Sudbury, Ontario, Canada) were employed as anode. The rack was immersed in the 100 liter bath between two anodes to affect total encapsulation of the coupons with fine-grained nickel. Plating current was supplied by a pulse power supply (Dynatronix, Amery, Wis., USA) and the plating time was 90 minutes.

TABLE 4

| Electrolyte Composition, Plating Conditions and Selected Coating Properties for n-Ni. | |
|---|---|
| Bath Chemistry | |
| 300 g/l $NiSO_4 \cdot 6H_2O$ | |
| 45 g/l $NiCl_2 \cdot 6H_2O$ | |
| 45 g/l $H_3BO_3$ | |
| 5 ml/l Nanoplate ®-B16 | |
| 10 ml/l Nanoplate ®-A24 | |
| Plating Conditions | |
| Electrolyte Temperature [° C.] | 60 |
| pH | 2.5 |
| Electrolyte Agitation Rate (normalized for cathode area) [ml/(min · $cm^2$)] | 33 |
| Rotation Speed [RPM] | N/A |
| Bath Flow Direction | Upwards |
| Particulate Bath Content (in suspension) | N/A |
| Anode Shielding | N/A |
| Average Current Density ($I_{avg}$) [mA/$cm^2$] | 100 |
| Forward Pulse On Time [ms] | 20 |
| Off Time [ms] | 20 |
| Reverse Pulse On Time [ms] | N/A |
| Peak Reverse Current Density [mA/$cm^2$] | N/A |
| Total cycle time [ms] | 40 |
| Frequency [Hz] | 25 |
| Duty Cycle [%] | 50 |
| Ni Material Properties | |
| Hardness (VHN) | 425 |
| Average Grain Size [nm] | 20 |

Table 5 illustrates the data obtained for the polyamide coupons coating weights using a commercial rack which was populated with 6 metallized coupons forming a single row in each run. The average plating weight in grams, the standard deviation, the standard deviation divided by the average weight in %, the kurtosis, the highest plating weight and lowest plating weight are displayed, as is the weight variation expressed in percent from the average plating weight for five consecutive runs.

The data indicate that the weight consistency obtained also varies from run to run with the standard deviation/average weight ratio ranging from ~28% to ~43%. The maximum weights vary between ~33% and ~43% from the average weight and the minimum weights between ~18 and ~20% from the average weight illustrating the lack of accurate weight/thickness control when using a parallel plating set up.

TABLE 5

| Position Specific Weights for Six Coupons Coated with n-Ni in Parallel Using a Rack in a Single-Cell Plating Tank | | | | | |
|---|---|---|---|---|---|
| POSITION | RUN 1 | RUN 2 | RUN 3 | RUN 4 | RUN 5 |
| 1 | 10.79 | 11.11 | 10.10 | 10.36 | 10.81 |
| 2 | 7.05 | 6.96 | 6.73 | 6.58 | 6.72 |
| 3 | 6.95 | 6.64 | 6.57 | 6.50 | 6.60 |
| 4 | 6.62 | 6.39 | 6.60 | 6.53 | 6.53 |
| 5 | 6.85 | 6.53 | 7.03 | 6.97 | 6.91 |
| 6 | 10.36 | 10.53 | 11.22 | 11.55 | 11.32 |
| Average Weight [g] | 8.10 | 8.03 | 8.04 | 8.08 | 8.15 |
| Standard Deviation | 1.92 | 2.18 | 2.07 | 2.26 | 2.27 |
| STDEV/Average Weight [%] | 33.2 | 38.4 | 39.5 | 42.9 | 27.8 |
| Kurtosis | −1.74 | −1.70 | −1.13 | −1.18 | −1.74 |
| Max Weight [g] (Deviation from Average [%]) | 10.79 (33.2%) | 11.11 (38.4%) | 11.22 (39.5%) | 11.55 (42.9%) | 11.32 (38.9%) |
| Min Weight [g] (Deviation from Average [%]) | 6.62 (−18.3%) | 6.39 (−20.4%) | 6.57 (−18.3%) | 6.50 (−19.6%)7 | 6.53 (−19.9%) |

BACKGROUND EXAMPLE 1

Polarization Curves in a Single Plating Cell and Multiple Plating Cell System Using a Shared Electrolyte Obtained on Ni and Carbon/epoxy Tubes 38" long, ~½ outer diameter nickel and metallized graphite/epoxy tubes (400 $cm^2$ surface area) were coated with fine-grained Ni up to a target coating weight of 40 g. The single plating cell comprised a tubular tank (4 ft high, ID: 1 ft, electrolyte volume: ~90 liter) equipped with a heater, recirculation system and a single anode basket. The work piece was mounted on a stainless steel feeder which was attached to a rotator. Similarly, in the case of the 36-multi-cell 2-compartment plating system (2500 liter) the graphite/epoxy tubes were mounted onto stainless steel current feeder rods. Two cathode tools, each equipped with 18 current feeders each, rotational means and appropriate wiring were employed. The single plating cell and the multi-cell plating system described above both contained the same modified Watts nickel bath illustrated in Table 4 of Prior Art Example 1. Nickel "R"-rounds (Inco Ltd., Sudbury, Ontario, Canada) were used as anode material and added to the 36 Ti anode baskets, each cell contained one anode. Electrodes, electrolyte and electrode distances (4") were identical in both tanks. In both tanks the plating current was supplied by one or more power modules (Dynatronix, Amery, Wis., USA) pulse power supplies which were synchronized and controlled by a central computer. The general electroplating conditions used are indicated in Table 6,the specific electrical parameters used in each experiment are described below.

TABLE 6

Plating Conditions.
Plating Conditions

| | |
|---|---|
| Electrolyte Temperature: | 60° C. |
| pH: | 2.5 |
| Electrolyte Agitation Rate (normalized for cathode area): | 33 ml/(min · $cm^2$) |
| Rotation Speed [RPM]: | 15 |
| Bath Flow Direction: | upwards |
| Particulate Bath Content (in suspension): | N/A |
| Anode Shielding: | As indicated |
| Average Current Density ($I_{avg}$) [mA/$cm^2$]: | As indicated |
| Forward Pulse On Time [ms]: | As indicated |
| Off Time [ms]: | As indicated |
| Reverse Pulse On Time [ms]: | As indicated |
| Peak Reverse Current Density [mA/$cm^2$]: | As indicated |
| Total cycle time [ms]: | As indicated |
| Frequency [Hz]: | As indicated |
| Duty Cycle [%]: | As indicated |

Figure 3:
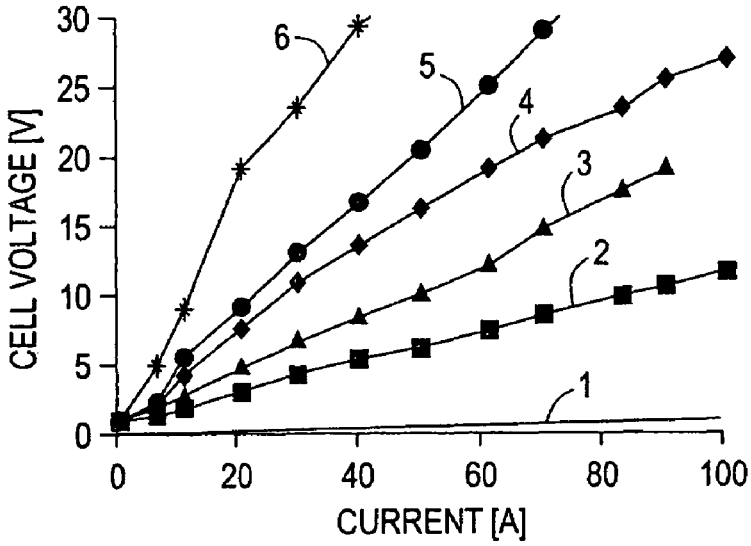
FIG. 3 illustrates voltage-current profiles for a number of workpieces in a plating cell.

Polarization curves were recorded for various tubes with various electrical contact means, with and without shielding and using direct current (DC) and pulse current. FIG. 3 shows the cell current/cell voltage relationship measured in the single part plating cell for a number of samples obtained by stepwise increasing the current from 0 A to 100 A (250 mA/cm ) and recording the appropriate cell voltages. Curve 1 shows the DC polarization curve for a Ni tube with the cell voltage corrected for internal-resistance (IR) losses using well known current interruption. As expected the IR-voltage was unaffected by the selection of the substrate (Ni or graphite-epoxy tube), the coating thickness, the contact arrangement and the electrode distance. Curve 2 shows the current/voltage response of the Ni tube using DC and through the wall electrical contact without shielding, i.e., the coating thickness of the tube rotated at 15 RPM remains essentially the same along the tube length and cross section. In this case of "through the wall" electrical contacts the current is provided to the inside of the tube by a stainless steel current feeder rod inserted into the ID of the tube. The electrical current then proceeds from the inner tube surface to the outer tube surface through the tube wall and plating is initiated at the outer tube surface where the electrochemical reduction of $Ni^{++}$ to metallic Ni-occurs. Curve 4 shows the current/voltage response of the graphite/epoxy tube rotated at 15 RPM using DC, through the wall contact and with the employ of shielding and current thieves, designed for the coating thickness to increase of the tube within the last 13" from 3.5 mils to 7.5 mils as illustrated in more detail in Working Example III. Curve 3 shows the same arrangement as curve 4, but an additional electrical contact is provided to the tube's outer surface which continuously reduces the Ohmic resistance of the work piece to be plated as the coating weight increases, thereby reducing the operating voltage required. In other words, in this arrangement current to the plating surface is provided both (1) through the wall via the stainless steel current feeder inserted in the tube and (2) directly onto the coating surface and the coating itself becomes another current feeder. As the coating thickness increases, the Ohmic resistance of the coating layer decreases and, in the case of poorly conducting substrates such as graphite/epoxy tubes, more and more of the current to the tube is provided through the coating layer itself. Curve 5 shows the same arrangement as curve 3 (through the wall and surface current feed), with the exception that the current provided is not DC but a pulse current with a duty cycle of 50% (8 ms on followed by 8 ms off) and the average current is displayed on the x-axis. Curve 6 shows the same arrangement as curve 4 (solely through the wall current feed), with the exception that the current provided is not DC but a pulse current with a duty cycle of 50% as in Curve 5. FIG. 3 illustrates the drastic effect of part selection, contact arrangement as well as shielding and thieving on the total operating cell voltage and the drastic voltage increases over the IR-free cell voltages.

Using identical parts and plating conditions, no difference was noted between polarization curves recorded in the single cell or the multi-cell plating system. Similarly when several parts were plated in the multi-cell plating system as illustrated in examples to follow the polarization curves remained essentially unchanged, other than the cell voltages doubled when two parts were plated in series, tripled for three parts in series and quadrupled for four parts plated in series.

BACKGROUND EXAMPLE 2

Figure 4:
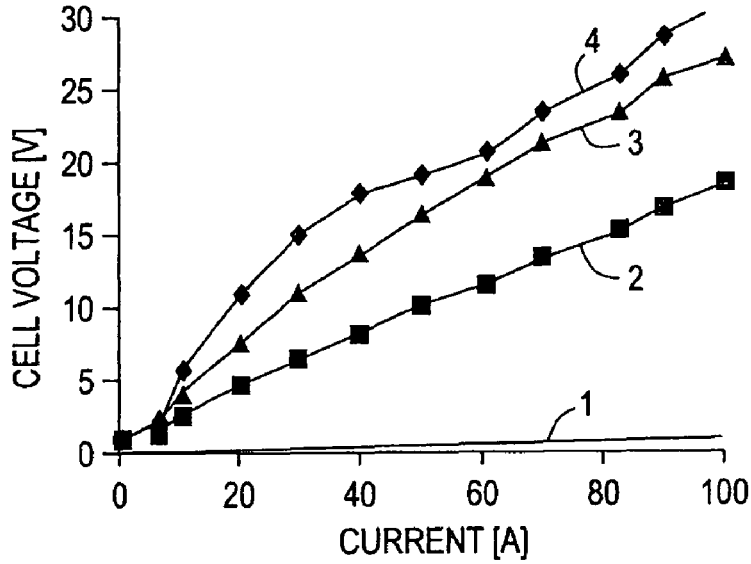
FIG. 4 illustrates voltage-current profiles for workpieces at various coating levels in a plating cell for DC plating.

DC Polarization Curves of Graphite/epoxy Tubes at Different Coating Weights in a Single Plating Cell and Multiple Plating Cell System The set up used was as described in Background Example 1. In this experiment the part plated was a metallized graphite/epoxy tube. FIG. 4 illustrates the change in polarization curves of a graphite/epoxy tube as the Ni coating weight increases. The tube is rotated at 15 RPM at all times during the experiment. Curve 1 shows the DC polarization curve for a graphite/epoxy tube with the cell voltage corrected for IR losses for a "through the wall contact". All remaining curves have been recorded using both through the wall and surface electrical contacts and employ shielding. Curve 4 shows the current/voltage response of the graphite/epoxy tube using DC and using both through the wall and surface contacts with shielding/thieving, as described, before any significant deposition of Ni occurs on the outer surface. Curve 3 shows the reduction in cell voltage after the Ni coating weight has increased to 4 g and Curve 2 the voltage response after a Ni coating weight of 40 g has been achieved.

BACKGROUND EXAMPLE 3

Figure 5:
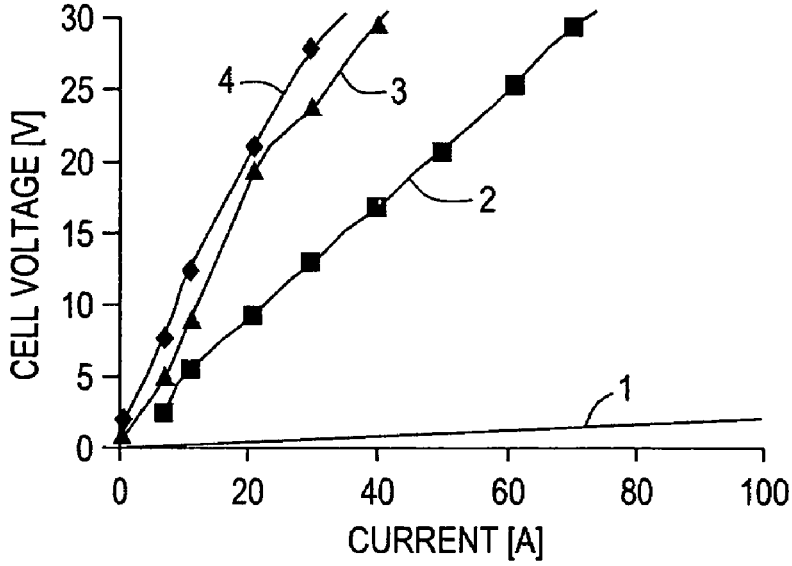
FIG. 5 illustrates voltage-current profiles for workpieces at various coating levels for pulse electrodepositing.

Pulse Current Polarization Curves of Graphite/epoxy Tubes at Different Coating Weights in a Single Plating Cell and Multiple Plating Cell System The set up used and experiment conducted was as described in Background Example 2 with the exception that DC plating was replaced by pulse current deposition (50% duty cycle). FIG. 5 illustrates the change in polarization curves of a metallized graphite/epoxy tube as the Ni coating weight increases. Curve 1 shows the average plating current for a graphite/epoxy tube with the cell voltage corrected for IR losses. Curve 4 shows the average current/voltage response of the graphite/epoxy tube with 50% duty cycle (8 ms on followed by 8 ms off time) and using both through the wall and surface contacts with shielding/thieving, as described, before any significant deposition of Ni occurs on the outer surface. Curve 3 shows the reduced cell voltage under the same conditions after the Ni coating weight increased to 4 g and Curve 2 after a Ni coating weight of 40 g has been achieved.

WORKING EXAMPLE I

Comparison of the Coating Weight Consistency Between a Single Plating Cell and Multiple Plating Cell System Using a Shared Electrolyte 38" long, ~½" outer diameter metallized graphite/epoxy tubes (400 $cm^2$ surface area) were coated with fine-grained Ni to a target coating weight of 38.5 g using the bath chemistry outlined in Table 4 in a single plating cell or multi-cell compartment plating system described above and using through the wall and surface contacts in all instances. The three specific plating schedules used and material properties achieved are indicated in Table 7.

TABLE 7

Electrodeposition Conditions Used and Selected Coating Properties.

| Plating Schedule | 1 | 2 | 3 |
|---|---|---|---|
| Electrolyte Temperature [° C.] | | 60 | |
| pH: | | 2.5 | |
| Electrolyte Agitation Rate (normalized for cathode area) [ml/(min · $cm^2$)] | | 33 | |
| Rotation Speed [RPM] | | 15 | |
| Bath Flow Direction | | Upwards | |
| Particulate Bath Content (in suspension) | | N/A | |
| Anode Shielding | | N/A | |
| Average Current Density ($I_{avg}$) [mA/$cm^2$] | 25 | 50 | 100 |
| Peak Forward Current Density [mA/$cm^2$] | 61 | 200 | 400 |
| Forward Pulse On Time [ms] | 90 | 8 | 2 |
| Off Time [ms] | 0 | 24 | 6 |
| Reverse Pulse On Time [ms] | 10 | 0 | 0 |
| Peak Reverse Current Density [mA/$cm^2$] | 300 | N/A | N/A |
| Total cycle time [ms] | 100 | 32 | 8 |
| Frequency [Hz] | 10 | 31 | 125 |
| Duty Cycle [%] | 90 | 25 | 25 |
| Ni Material Properties | | | |
| Hardness (VHN) | 214 | 416 | 470 |
| Average Grain Size [nm] | 275 | 85 | 40 |

This example compares the part consistency obtained in a single plating cell plating one part at a time and compares it to a multi-cell compartment plating system for plating 36 parts at a time in two compartments each compartment containing 18 parts in six matching strings, each containing 3 cells in series as illustrated in FIG. 2. The plating schedule has been set to achieve a nominal plating weight of 38.5 g (plating schedule 1 for 1 minute followed by plating schedule 2 for 17 minutes, followed by plating schedule 3 for 50 minutes, totaling 39 Ah per part in 68 minutes.

Table 8 illustrates the data obtained. Using the single cell tank 18 tubes were plated one after the other and the average plating weight in grams, the standard deviation, the standard deviation divided by the average weight in %, the kurtosis, the highest plating weight and lowest plating weight are displayed, as is the minimum and maximum weight deviation expressed in percent from the average plating weight. In the case of the multi-cell plating tank one compartment containing 18 tubes were plated simultaneous (six 3-cell strings each controlled by its own power supply, all 6 power supplies being synchronized) and the same parameters are recorded as for the single cell runs. The values for two consecutive separate runs are displayed. The data indicate that the weight consistency obtained is similar for plating a single part at a time and for plating 18 parts simultaneously (6 strings of 3 parts in series).

TABLE 8

Coating Weight Comparison of Tubes Plated One at the Time and 18 Tubes Plated Simultaneously Using the Multi-Cell Plating System.

| POSITION | SINGLE CELL CONTROL [g] | MULTI-CELL RUN 1 [g] | MULTI-CELL RUN 2 [g] |
|---|---|---|---|
| 1 | 38.9 | 38.4 | 38.6 |
| 2 | 38.7 | 38.8 | 38.5 |
| 3 | 38.5 | 38.5 | 38.5 |
| 4 | 38.4 | 38.4 | 38.5 |
| 5 | 38.3 | 38.4 | 38.5 |
| 6 | 39.9 | 38.6 | 38.5 |
| 7 | 38.2 | 38.5 | 38.3 |
| 8 | 38.4 | 38.9 | 39.2 |
| 9 | 38.6 | 38.4 | 38.1 |
| 10 | 38.4 | 37.8 | 38.3 |
| 11 | 37.5 | 38.2 | 38.1 |
| 12 | 37.5 | 38.1 | 38.3 |
| 13 | 36.7 | 38.5 | 38.2 |
| 14 | 37.4 | 39.6 | 40.0 |
| 15 | 37.2 | 38.4 | 38.1 |
| 16 | 39.2 | 38.0 | 38.1 |
| 17 | 40.3 | 39.2 | 38.8 |
| 18 | 40.5 | 38.1 | 38.1 |
| Average Weight [g] | 38.48 | 38.49 | 38.48 |
| Standard Deviation | 1.03 | 0.43 | 0.48 |
| STDEV/Average Weight [%] | 2.69 | 1.12 | 1.24 |
| Kurtosis | −0.10 | 1.62 | 5.70 |
| Max Weight (Deviation from Average) | 40.5 (+5.3%) | 39.6 (+2.9%) | 40.0 (+3.9%) |
| Min Weight (Deviation from Average) | 36.7 (−4.6%) | 37.8 (−1.8) | 38.1 (−1.0%) |

WORKING EXAMPLE II

Multiple Plating Cell System Using a Shared Electrolyte Plating 3 Cell and 4 Cell Series Strings The multi-cell tank was wired to enable the simultaneous plating of a three and a four cell string. In the case of the three cell string, cell 1, cell 7 and cell 13 were equipped with anodes and cathodes, the remaining cells contained no electrodes. In the case of the four cell string, cell 1, cell 6, cell 11 and cell 16 were equipped with anodes and cathodes, the remaining cells contained no electrodes. 38" long, ~½" outer diameter metallized graphite/epoxy tubes were used as substrates. Bath composition and plating conditions were as illustrated in experiment 1 of Background Example 1 except that the electrical plating profile in experiment 1 consisted of two steps: (1) DC at a current density of 50 mA/cm$^2$ or 20 A for 20 min, and (2) DC at a current density of 100 mA/cm$^2$ or 40 A for 49 min. The total charge passed over the 69 minute schedule amounted to 39.3 Ah. No shielding was employed.

Figure 6:
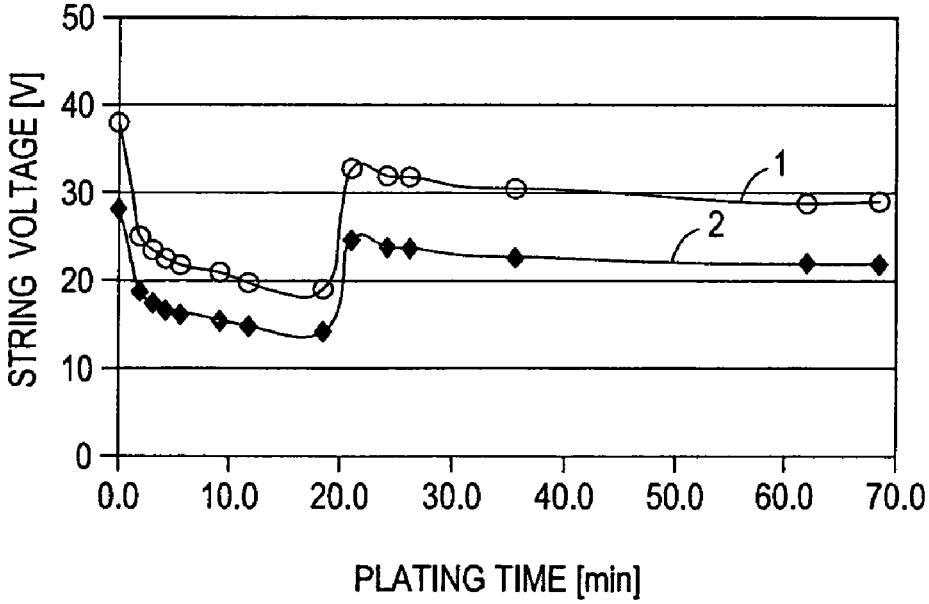
FIG. 6 illustrates voltage-time profiles for 3-part and 4-part series plating strings.

FIG. 6 shows voltage/time profiles with curve 1 depicting the voltage of the 4-cell string and curve 2 denoting the voltage of the 3-cell string, respectively. Electrical contact to the work piece (graphite/epoxy tube) tube surface to be plated is achieved through the stainless steel current feeder (through the wall plating) and by making contact to the surface of the tube itself. Initially, all current is provided through the tube wall, but as the thickness of the metallic layer plated on the surface builds up, more and more of the current is supplied through the coating itself and the overall Ohmic resistance of the current feeder/work piece drops which results in a voltage drop with time in each of the two constant current plating schedules as FIG. 6 illustrates. Three multi-cell runs each were performed and analyzed with respect to string to string voltage and variations. The voltage profiles were repeatable and coating weights of all parts was very similar with part to part weight variation of less than ±2.5% regardless whether three or four tubes were plated simultaneously.

Figure 7:
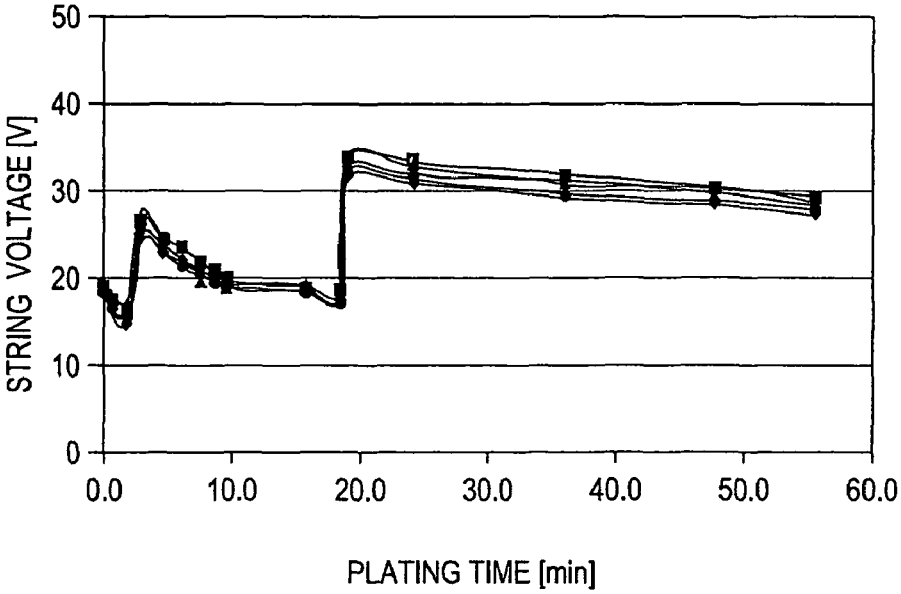
FIG. 7 illustrates voltage-time profiles for six 3-part strings of graphite/epoxy tubes using a three-step plating profile.

FIG. 7 shows voltage/time profiles for all six 3-part strings in a plating run (experiment 2) using a three step plating schedule: step 1: 10 A DC for 3 minutes; step 2: 20 A DC for 16 minutes; step 3: 40 A DC for 37 minutes for a total of 30.5 Ah in 56 minutes employing shielding.

Specifically to the shielding, ~65% of the anode surface was covered with a polypropylene sheet to reduce the local current density along 25" of the tube intended to have a uniform thickness of approximately 0.0035". The shield was tapered at the transition from constant coating thickness to increased coating thickness to gradually increase the current density of the remaining 13" of the tube to 0.0075", as intended. As the voltage profiles were similar in all cells at all times the coating weights of all parts was very similar with part to part weight variation of less than ±5%.

WORKING EXAMPLE III

Comparison Between Single Plating Cell and Multiple Plating Cell System Using a Shared Electrolyte Plating 3 Cell Series Strings/SHIELDING The multi-cell tank was wired to enable the simultaneous plating of three cell strings as illustrated in FIG. 2. Bath composition and plating conditions were as illustrated in experiment 2 of Background Example 1 except that the plating schedule consisted of three steps: (1) 10 A DC for 1 minute (2) 20 A DC for 17 minutes and (3) 40 A DC for 50 minutes (39 Ah over 68 minutes).

Employing anode shielding and current thieves the thickness profile was adjusted to gradually decrease the thickness of the metallic layer at one end of the tube from 0.0075" to 0.0035" over 13" of the 38" long tube, the thickness of the remaining 25" was maintained at 0.0035". Due to the anode shields employed the operating voltages increased by between 10-25%. Specifically to the shielding, ~65% of the anode surface was covered with a polypropylene sheet to reduce the local current density along 25" of the tube intended to have a uniform thickness. The shield was tapered at the transition from constant coating thickness to increased coating thickness to gradually increase the current density of the remaining 13" of the tube to 0.0075", as intended. The actual taper shape in the transition zone was determined by trial and error.

Current thieving was employed to smoothen the tube tip area as follows: ½" diameter, 1/16" thick Ni-washers were mounted on a rubber stopper and the rubber stopper/Ni-washer plugs inserted into the bottom end of the tube. The rubber stopper held the Ni-washer in place and simultaneously sealed the tube preventing electrolyte ingress into the tube. The Ni-washer rested against the bottom end of the tube making electrical contact to it and was therefore electroplated during a plating run. After the run the Ni-washer/rubber plug assembly was removed and discarded. Each washer received about 1 g of coating and ensured that there were no edge effects such as dendrites and the taper near the tip remained fairly liner, as intended.

Figure 8:
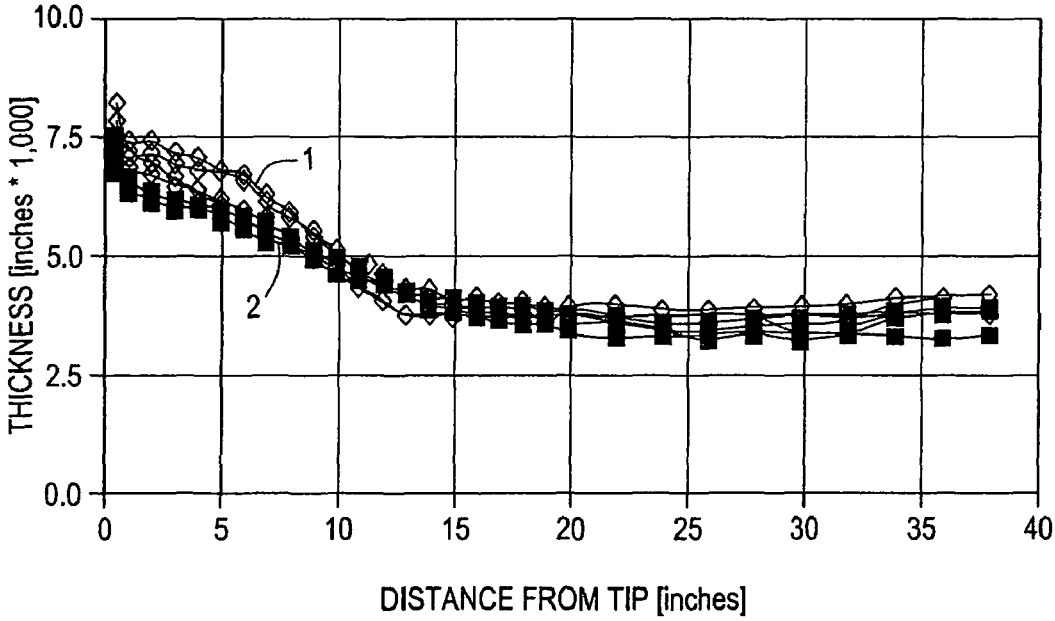
FIG. 8 illustrates coating thickness profiles for parts plated in a single cell and parts plated in a multi-cell plating system, i.e. provides a single cell tank and a multi-cell tank thickness profile comparison.

Selected tube thickness profiles for four tubes plated in the single cell tank (curve set 1) and four tubes plated in four runs of 18 tubes each in the multi-cell system (curve set 2) are depicted in the table above are displayed in FIG. 8 which also highlights the target profile (dashed line). The Nanoplate weights of the coatings ranged from 38.0 to 39.8 g. The data indicate that the thickness reproducibility is within 0.001" (measurement accuracy is ±0.0005"). Thickness measurements were obtained cutting the tubes in ½" intervals and using cross sectional metallographic techniques to measure total coating thickness and thickness uniformity. Within the measurement accuracy no changes whatsoever in thickness uniformity on any cross-sectional cuts were noticed which was attributed to the tube rotation during plating. As the total average plating weight of all tubes remained the same (38.5 g), the perceived slight increase in overall thickness of tubes plated in the single cell tank therefore appears to be due to measurement inaccuracies. Within the limits of measurement accuracy the thickness profiles of all parts, regardless of the tank they were plated in, are comparable.

WORKING EXAMPLE IV

Thickness Profile and Weight Consistency Determination for the Multiple Plating Cell System Using a Shared Electrolyte/SHIELDING The multi-cell tank and conditions described in Working Example III were used. In a single plating run 18 parts were plated simultaneously using one compartment and one tool populated with 18 metallized graphite fiber/epoxy tubes. Plating weight and the coating thickness 1" from the tip of the tapered section were measured. Table 9 illustrates that excellent plating thickness and plating weight consistencies were obtained.

TABLE 9

Tip Coating Thickness and Coating Weight Comparison of 18 Tubes Plated Simultaneously Using the Multi-Cell Plating System.

| STRING NUMBER | CELL POSITION NUMBER | TIP THICKNESS 1" FROM THE TIP [1,000 × in] | COATING WEIGHT [g] |
|---|---|---|---|
| 1 | 1 | 6.8 | 38.3 |
| | 7 | 7.1 | 37.9 |
| | 13 | 6.9 | 37.9 |
| 2 | 2 | 7.2 | 38.4 |

TABLE 9-continued

Tip Coating Thickness and Coating Weight Comparison of 18 Tubes Plated Simultaneously Using the Multi-Cell Plating System.

| STRING NUMBER | CELL POSITION NUMBER | TIP THICKNESS 1" FROM THE TIP [1,000 × in] | COATING WEIGHT [g] |
|---|---|---|---|
| | 8 | 7.0 | 38.4 |
| | 14 | 7.4 | 39.6 |
| 3 | 3 | 6.8 | 38.4 |
| | 9 | 7.5 | 38.4 |
| | 15 | 7.0 | 38.4 |
| 4 | 4 | 6.5 | 38.4 |
| | 10 | 7.1 | 38.1 |
| | 16 | 7.2 | 38.2 |
| 5 | 5 | 7.0 | 38.5 |
| | 11 | 7.1 | 38.5 |
| | 17 | 6.8 | 38.4 |
| 6 | 6 | 7.3 | 38.3 |
| | 12 | 7.0 | 38.2 |
| | 18 | 7.1 | 38.2 |
| Run Average | | 7.0 | 38.4 |
| Standard Deviation | | 0.24 | 0.36 |
| STDEV/Average Weight [%] | | 3.38 | 0.93 |
| Kurtosis | | 0.65 | 9.09 |
| Max Value (Deviation from Average [%]) | | 7.5 (+6.5%) | 39.6 (+3.2%) |
| Min Value (Deviation from Average [%]) | | 6.5 (−7.7%) | 37.9 (−1.2%) |
| Measurement Accuracy | | ±0.5 | ±0.1 |

WORKING EXAMPLE V

Weight Consistency Determination for the Multiple Plating Cell System Using a Shared Electrolyte/SHIELDING The multi-cell tank and conditions described in Working Example III were used. Four plating runs of 18 parts each were performed using one compartment and one tool populated with 18 metallized graphite fiber/epoxy tubes and one run was performed plating one part at a time. Three runs were performed with the 10A-1 minute/20A-17 minutes/40A-50 minutes schedule for a total of 39.2 Ah within 68 minutes. In run four the schedule was changed to 10 A-1 minute/30 A-10 minutes/60 A-34 -minutes respectively for the same 39.2 Ah throughput per part but within a plating time of 45 minutes. The accelerated plating run (run #4) reduced the overall plating time by 23 minutes or 34% thereby increasing the overall plating voltages. Table 10 illustrates that good plating weight consistency was achieved in all multiple part runs with comparable reproducibility when compared to the last run plating one part at a time.

Table 10 also reports the maximum operating voltages in each step for the four runs, the three "conventional" and the one "high rate" run. The data of the three conventional runs suggests that $V_{max}$ per step vary between runs. String to string voltage variations observed are typically <4V. All tube coating weights remained within 5% of the average coating weights displaying excellent coating uniformity.

TABLE 10

Position Specific Weights and Voltages for Four Multi-Cell Single-Compartment Plating System Runs

| POSITION | RUN 1 | RUN 2 | RUN 3 | RUN 4 | SINGLE CELL CONTROL |
|---|---|---|---|---|---|
| 1 | 38.6 | 38.3 | 38.3 | 38.6 | 38.2 |
| 2 | 38.6 | 38.4 | 38.5 | 38.7 | 38.6 |
| 3 | 38.8 | 38.4 | 38.4 | 38.9 | 38.4 |
| 4 | 38.7 | 38.4 | 34.5 | 38.8 | 38.7 |
| 5 | 38.7 | 38.5 | 38.5 | 38.8 | 38.8 |
| 6 | 38.6 | 38.3 | 38.3 | 38.7 | 39.2 |
| 7 | 38.3 | 37.9 | 37.9 | 38.3 | 38.6 |
| 8 | 38.6 | 38.4 | 38.4 | 38.8 | 38.9 |
| 9 | 38.7 | 38.4 | 38.6 | 38.8 | 39.1 |
| 10 | 38.2 | 38.1 | 38.1 | 38.7 | 38.7 |
| 11 | 38.6 | 38.5 | 38.6 | 39.0 | 38.9 |
| 12 | 38.3 | 38.2 | 38.2 | 38.5 | 38.5 |
| 13 | 38.2 | 37.9 | 37.9 | 38.2 | 38.5 |
| 14 | 39.3 | 39.6 | 40.0 | 39.7 | 38.2 |
| 15 | 38.7 | 38.4 | 37.5 | 38.8 | 38.3 |
| 16 | 38.2 | 38.2 | 38.2 | 38.6 | 38.7 |
| 17 | 38.5 | 38.4 | 38.5 | 38.8 | 38.2 |
| 18 | 38.4 | 38.2 | 38.3 | 38.5 | 38.4 |
| Average Weight [g] | 38.6 | 38.4 | 38.2 | 38.7 | 38.6 |
| Standard Deviation | 0.27 | 0.36 | 1.04 | 0.31 | 0.30 |
| STDEV/Average Weight [%] | 0.70 | 0.93 | 2.72 | 0.81 | 0.78 |
| Kurtosis | 2.17 | 9.09 | 10.15 | 4.99 | −0.56 |
| Max Weight [g] (Deviation from Average [%]) | 39.3 (+1.8%) | 39.6 (+3.1%) | 40.0 (+4.7%) | 39.7 (+2.6%) | 39.2 (+1.5%) |
| Min Weight [g] (Deviation from Average [%]) | 38.2 (−1.0%) | 37.9 (−1.3%) | 37.5 (−1.8%) | 38.2 (−1.3%) | 38.2 (−1.1%) |
| $V_{max}$ Step 1 [V] | 23 | 23 | 16 | 16 | — |

TABLE 10-continued

Position Specific Weights and Voltages for Four Multi-Cell Single-Compartment Plating System Runs

| POSITION | RUN 1 | RUN 2 | RUN 3 | RUN 4 | SINGLE CELL CONTROL |
|---|---|---|---|---|---|
| $V_{max}$ Step 2 [V] | 20 | 24 | 24 | 32 | — |
| $V_{max}$ Step 3 [V] | 28 | 27 | 27 | 39 | — |
| Plating time [min] | 75 | 75 | 75 | 45 | 75 |

WORKING EXAMPLE VI

Weight Consistency Determination for the Multiple Plating Cell System Using a Shared Electrolyte/SHIELDING The multi-cell tank and conditions described in Working Example III were used except that the plating schedule was revised to reduce the target coating weight from 38.5 g to 35.0 g. Three plating run were performed using both compartments with two cathode tool populated with 18 graphite fiber/epoxy tubes each. Three runs, each passing 34.2 Ah, were performed using two plating schedule. Plating schedule 1 (run #1) comprised three current steps 10 A-1 minute/20 A-16 minutes/40 A-43 minutes for a total of 34.2 Ah within 60 minutes. Plating schedule 2 (runs #2 and #3) comprised five current steps 10 A-1 minute/20 A-2 minutes/30 A-3 minutes/40 A-4 minutes/50 A-35 minutes for a total of 34.2 Ah within 45 minutes. As 34.2 Ah were used in each run, the overall plating times decreased by 25% from 60 minutes (run 1) to 45 min for the other two runs. Table 11 illustrates that good plating weight consistency was obtained.

Table 11 also reports the maximum operating voltages in each step for the three runs, the "conventional" and the two "high rate" runs displaying the voltage range in each step for all 12 strings. String to string voltage variations observed were low resulting in excellent weight and thickness profile uniformity and all tube coating weights remained within 5% of the average coating weights displaying good coating uniformity.

TABLE 11

Position Specific Weights and Voltages for Three Multi-Cell Two-Compartment Plating System Runs

| POSITION NUMBER | RUN 1 | RUN 2 | RUN 3 |
|---|---|---|---|
| 1 | 34.3 | 35.5 | 35.4 |
| 2 | 35.0 | 35.4 | 35.3 |
| 3 | 34.5 | 35.6 | 35.4 |
| 4 | 34.6 | 35.6 | 35.4 |
| 5 | 34.8 | 35.6 | 35.3 |
| 6 | 34.2 | 35.4 | 35.1 |
| 7 | 34.4 | 35.2 | 35.4 |
| 8 | 34.9 | 35.5 | 35.4 |
| 9 | 34.0 | 35.5 | 35.3 |
| 10 | 34.9 | 35.7 | 35.1 |
| 11 | 34.5 | 35.5 | 35.5 |
| 12 | 34.4 | 35.4 | 34.7 |
| 13 | 34.6 | 35.3 | 35.0 |
| 14 | 34.7 | 35.7 | 35.6 |
| 15 | 34.5 | 35.1 | 35.0 |
| 16 | 34.7 | 35.5 | 35.3 |
| 17 | 35.1 | 35.3 | 35.6 |
| 18 | 34.8 | 35.4 | 35.5 |
| 19 | 35.0 | 34.5 | 35.5 |
| 20 | 34.4 | 35.5 | 35.8 |
| 21 | 34.7 | 35.1 | 35.4 |

TABLE 11-continued

Position Specific Weights and Voltages for Three Multi-Cell Two-Compartment Plating System Runs

| POSITION NUMBER | RUN 1 | RUN 2 | RUN 3 |
|---|---|---|---|
| 22 | 34.8 | 35.4 | 35.7 |
| 23 | 34.8 | 35.4 | 35.3 |
| 24 | 34.5 | 35.5 | 35.5 |
| 25 | 34.7 | 35.2 | 35.1 |
| 26 | 34.5 | 35.4 | 35.3 |
| 27 | 34.8 | 35.2 | 35.4 |
| 28 | 34.5 | 35.3 | 35.5 |
| 29 | 34.5 | 35.6 | 35.5 |
| 30 | 34.4 | 34.5 | 35.5 |
| 31 | 34.7 | 34.9 | 35.3 |
| 32 | 34.7 | 35.9 | 35.4 |
| 33 | 34.9 | 34.7 | 35.9 |
| 34 | 34.6 | 35.1 | 34.6 |
| 35 | 34.6 | 34.5 | 35.2 |
| 36 | 34.6 | 34.7 | 35.3 |
| Average Weight [g] | 34.6 | 35.3 | 35.3 |
| Standard Deviation | 0.23 | 0.35 | 0.26 |
| STDEV/Average Weight [%] | 0.68 | 1.00 | 0.74 |
| Kurtosis | 0.39 | 0.50 | 1.75 |
| Max Weight [g] (Deviation from Average [%]) | 35.0 (+1.2%) | 35.9 (+1.7%) | 35.9 (+1.7%) |
| Min Weight [g] (Deviation from Average [%]) | 34.0 (−1.7%) | 34.5 (−2.3%) | 34.6 (−2.0%) |
| String $V_{max}$ Step 1 (10A) Range [V] | 18-19 | 14-15 | 13-13 |
| String $V_{max}$ Step 2 (20 A) Range [V] | 22-23 | 23-24 | 22-23 |
| String $V_{max}$ Step 3 (30A) Range [V] | N/A | 30-30 | 29-29 |
| String $V_{max}$ Step 4 (40A) Range [V] | 31-32 | 35-37 | 35-35 |
| String $V_{max}$ Step 5 (50A) Range [V] | N/A | 40-40 | 38-39 |
| Total Plating Time [min] | 60 | 45 | 45 |

WORKING EXAMPLE VII

Weight Consistency Determination for the Multiple Plating Cell System Using a Shared Electrolyte The multi-cell tank and conditions described in Working Example II experiment 1 (three cell string) were used (see Table 12). The plating schedule consisted of two steps: 20 A for 20 minutes followed by 100 mA/cm$^2$ for 49 minutes passing a total of 39.3 Ah. No shielding was employed.

A number of plating runs was performed and selected parts and conditions were manipulated to create operating voltage differences between cells and the effect of voltage differences on coating weight uniformity assessed. The results are displayed in Table 12.

As highlighted before ideally one part at a time is plated in a single plating tank to achieve uniform plating weights. In the multi-cell plating design all cells are ionically connected (e.g. they share one-electrolyte hence are shorted ionically) to simplify bath management and lower the capital and operating cost. To control "shunt currents" baffles, spacers on the weirs were incorporated into the design to make the path for shorting/current sharing as torturous as possible. To illustrate that good plating weight uniformity can be achieved the first run was performed by plating three parts simultaneously in a 3-cell string. Three Ni tubes were plated in series in run 1. To minimize shunt currents and maximize the electrolyte resistance between parts, cells used were #2,#8 and #14. All the remaining cells had their respective anodes and cathodes submersed in their respective cells but not connected to a power supply. Run 2 is a run plating 18 parts at a time with the electrical configuration outlined in FIG. 2 (6 strings of 3 parts in series each). Run 3 is a replication of run 1 with through the substrate wall plating, except for the substrates are metallized graphite/epoxy tubes. As the resistivity of the metallized graphite/epoxy tubes is much higher than the one of the corresponding Ni tubes, plating voltages are significantly higher. Weight uniformity is very poor (~22% weight difference) indicating that some plating occurred in adjacent cells. Run 4 was similar to run 3 except that a secondary electrical contact was provided to the graphite/epoxy tube surface and current was therefore initially supplied "through the wall" only and as the thickness of the NiFe alloy coating increased more and more of the plating current was provided through the coated surface itself reducing the plating voltages by ~5V and thereby reducing the maximum voltage difference between adjacent cells and improving plating weight consistency. Run 5 was similar to run 3 except that the idle cells were polarized by impressing a 6V/cell cell voltage, thereby reducing the maximum voltage difference between adjacent cells and improving plating weight consistency. Run 6 was similar to run 4 except that the idle cells were polarized by impressing a 6V/cell voltage, thereby reducing the maximum voltage difference between adjacent cells and improving plating weight consistency. Run 7 was similar to run 4 except that the idle cells were polarized by impressing a 8V/cell cell voltage, thereby reducing the maximum voltage difference between adjacent cells and improving plating weight consistency.

TABLE 12

Various Multi-Cell Plating System Runs Exploring Cell Voltage Differences Yielding Consistent and Inconsistent Plating Weights.

| RUN NUMBER | RUN INFORMATION | MAX VOLTAGE PER CELL @ 20 A [V] | MAX VOLTAGE PER CELL @ 40 A [V] | "INACTIVE" CELL VOLTAGE [V] | MAX VOLTAGE DIFFERENCE OF ADJACENT CELLS [V] | WEIGHT UNIFORMITY OBSERVED (MAX-MIN WEIGHT DIFFERENCE IN [%] AND [g]) |
|---|---|---|---|---|---|---|
| 1 | Three Metal Tubes in One 3-Part String | ~4 | ~7 | 0 | 4-7 | 2.0%/0.8 g excellent |
| 2 | 18 Metal Tubes in 6 3-Part Strings | ~4 | ~7 | N/A | 2-5 | 5.9%/2.3 g good |
| 3 | Three Graphite/Epoxy Tubes in One 3-Part String (Through the Wall Contact Only) | ~13 | ~13 | 0 | 13 | 21.7%/8.5 g poor |
| 4 | Three Graphite/Epoxy Tubes in one 3-Part String (Through the Wall and Surface Contact) | ~8 | ~8 | 0 | 8 | 9.7%/3.8 g acceptable |
| 5 | As Run 3 But Inactive Cells Polarized to 6 V | ~13 | ~13 | 6 | 7 | 3.8%/1.5 g good |
| 6 | As Run 4 But Inactive Cells Polarized to 6 V | ~11 | ~8 | 6 | 2-5 | 3.8%/1.5 g good |
| 7 | As Run 4 But Inactive Cells Polarized to 8 V | ~11 | ~8 | 8 | 0-3 | 0.5%/0.2 g excellent |

As highlighted above the high voltage differences tolerated between adjacent cells before the coating weight uniformity is seriously compromised is due to the careful system design which minimizes shunt currents as outlined above. Table 12 illustrates that cell to cell voltage differences of up to 7V can be tolerated before the coating weight consistency suffers.

In the runs where not all strings are utilized, the non-utilized electrodes remain at "floating electrochemical potentials", i.e. their rest potential while the strings being powered assume the appropriate electrochemical potential for the applied current. While we do not wish to be bound by theory, applying an external voltage to selected strings results in the creation of potential differences between electrodes in adjacent cells. With most of the parameters fixed (electrolyte location, distance, ionic pathways etc.) the main variable becomes the potential differences between all electrodes to each other which depends on potential and cell voltage differences. The higher the potential difference e.g. between electrodes in adjacent cells the higher the risk for appreciable "shunt currents" to develop, negatively affecting weight uniformity. In this experiment the voltage differences were created on purpose and controlled; however, in a practical system electrode potential differences arise for a number of reasons which can not be predicted/controlled. Table 12 indicates that the multi-cell plating system used can tolerate significant potential differences between adjacent cells before experiencing serious weight uniformity problems. Of course the particular voltage differences which can be tolerated depend on multi-cell system design, the electrolyte conductivity, parts resistivity, the level of shielding, applied current, etc.

Variations

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. Method for simultaneously electrodepositing a metallic material layer on each of at least two permanent or temporary substrates comprising the steps of:

(a) providing a central electrolyte well supplying electrolyte to at least one compartment comprising at least two ionically intercommunicating adjacent plating cells;

(b) immersing each said substrate of the at least two said substrates and their respective anodes in the electrolyte shared among said at least two ionically intercommunicating adjacent plating cells;

(c) simultaneously supplying electrical power in series from a single source to at least two said substrates and their respective anodes placed in said ionically intercommunicating adjacent plating cells;

(d) setting and/or regulating electrodepositing parameters;

(e) supplying a negative charge to each said substrate and providing equal current flow to each said substrate to provide electrodeposited metallic material layer; and (f) removing each said substrate from said ionically intercommunicating adjacent plating cells.

2. Method for simultaneously electrodepositing a metallic material layer on each of at least four permanent or temporary substrates comprising the steps of:

(a) providing a central electrolyte well supplying electrolyte to at least one compartment comprising at least four ionically intercommunicating plating cells;

(b) immersing each said substrate of the at least four said substrates and their respective anodes in the electrolyte shared among said at least four ionically intercommunicating plating cells;

(c) simultaneously supplying electrical power from one power supply in series to at least two said substrates and their respective anodes placed in said ionically intercommunicating plating cells and simultaneously supplying electrical power from at least one other power supply in series to at least two other said substrates and their respective anodes placed in said ionically intercommunicating plating cells; (d) synchronizing said power supplies to minimize voltage fluctuations between plating cells;

(e) setting and/or simultaneously regulating electrodepositing parameters;

(f) supplying a negative charge to each said substrate and providing equal current flow to each said substrate to provide electrodeposited metallic material layer; and (g) removing each said substrate from said ionically intercommunicating plating cells.

3. Method for simultaneously electrodepositing a metallic material layer on each of at least four permanent or temporary substrates comprising the steps of:

(a) providing a central electrolyte well supplying electrolyte to at least one compartment comprising at least four ionically intercommunicating plating cells;

(b) immersing each said substrate of the at least four said substrates and their respective anodes in the electrolyte shared among said at least four ionically intercommunicating plating cells;

(c) simultaneously supplying electrical power from one power supply in series to at least two said substrates and their respective anodes placed in said ionically intercommunicating plating cells, and simultaneously supplying electrical power from at least one other power supply in series to at least two other said substrates and their respective anodes placed in said ionically intercommunicating plating cells, wherein said ionically intercommunicating plating cells connected along a same power supply are not adjacent to each other;

(d) synchronizing said power supplies to minimize voltage fluctuations between plating cells;

(e) setting and/or simultaneously regulating electrodepositing parameters;

(f) supplying a negative charge to each said substrate and providing equal current flow to each said substrate to provide electrodeposited metallic material layer; and (g) removing each said substrate from said ionically intercommunicating plating cells.

4. The method of claim 1 or claim 2 or claim 3 where the electrodepositing parameters are selected so that all said electrodeposited metallic material layers have a same microstructure selected from the group consisting of a fine-grained microstructure with an average grain size ranging from 2 nm to 5,000 nm, a coarse-grained microstructure with an average grain size over 5,000 nm and an amorphous microstructure.

5. The method of claim 1 or claim 2 or claim 3 where the electrodepositing parameters are selected so that all said electrodeposited metallic material layers have a same graded grain size.

6. The method according to claim 1 or claim 2 wherein all said metallic material layers comprise a metal or an alloy of one or more elements selected from the group consisting of Ag, Au, Cu, Co, Cr, Mo, Ni, Sn, Fe, Pd, Pb, Pt, Rh, Ru, and Zn and optionally one or more elements selected from the group consisting of B, P, C, S and W.

7. The method according to claim 1 or claim 2 wherein all said metallic material layers contain at least one element selected from the group consisting of:

(a) one or more metals selected from the group consisting of Ag, Au, Cu, Co, Cr, Mo, Ni, Sn, Fe, Pd, Pb, Pt, Rh, Ru, and Zn, (b) at least one element selected from the group consisting of C, O and S; and (c) optionally at least one or more elements selected from the group consisting of B, P, and W.

8. The method of claim 1 or claim 2, wherein all said substrates are selected from the group consisting of an orthopedic prosthesis, gun barrel, mold, sporting good, cell phone and automotive component.

9. The method according to claim 1 or claim 2, wherein said substrates are gun barrels.

10. The method of claim 1 or claim 2 for simultaneously plating a plurality of said substrates where each said plating cell, having at least one said substrate and one anode immersed therein, has electrodepositing parameters in each said plating cell of average current density ranging from 5 to 10,000 mA/cm$^2$, forward pulse on time ranging from 0.1 to 10,000 ms, pulse off time ranging from 0 to 10,000 ms, reverse pulse on time ranging from 0 to 500 ms, peak forward current density ranging from 5 to 10,000 mA/cm$^2$, peak reverse current density ranging from 5 to 20,000 mA/cm$^2$, frequency ranging from 0 to 1,000 Hz, a duty cycle ranging from 5 to 100%, and electrolyte temperature ranging from 0 to 100° C.

11. The method of claim 1 or claim 2, further comprising the step of rotating each said substrate having a rotation speed ranging from 0 to 1,500 RPM against its stationary anode while a negative charge is supplied to each said substrate.

12. The method of claim 1 or claim 2, further comprising the step of agitating the central electrolyte well with an electrolyte agitation rate ranging from 1 to 6,000 ml per min and per cm$^2$ electrode area, wherein said electrolyte in each of said plating cells is aqueous, has a pH ranging from 0 to 12, and a particulate content ranging from 0 to 70% by volume.

13. The method of claim 1 or claim 2, wherein part-to-part variability of said simultaneously plated substrates obtained is manifested by a ratio of maximum layer weight to average layer weight of less than ±20% and/or a ratio of layer weight standard deviation to average layer weight of less than ±20% and/or in the case of four or more substrates a kurtosis of less than 10.

14. The method of claim 1 or claim 2, further comprising the step of simultaneously modulating electrodepositing parameters for said metallic material layers so that all said electrodeposited metallic material layers have a same varied property selected from the group consisting of the grain size, hardness, yield strength, resilience, internal stress, and sublayer thickness.

15. The method of claim 1 or claim 2, further comprising the step of simultaneously modulating electrodepositing parameters for said metallic material layers so that all said electrodeposited metallic layers have the same sublayers.

16. The method of claim 1 or claim 2, further comprising the step of simultaneously modulating electrodepositing parameters for said metallic material layers so that all said electrodeposited metallic material layers have the same sublayers and the sublayer thickness is in the range 1.5 nm to 500 nm.

17. The method of claim 1 or claim 2, further comprising the steps of:

mounting said substrates to be simultaneously plated onto a cathode tooling assembly;

lowering said cathode tooling assembly into the multi-cell compartment containing said plating cells so that each substrate is inserted into each plating cell; and removing said cathode tooling assembly after completion of plating from said multi-cell plating compartment.

18. The method of claim 1 or claim 2 for simultaneously plating a plurality of said substrates, wherein said electrodepositing of the material layer is on at least a portion of each said substrate.

19. The method of claim 1 or claim 2 or claim 3 where the electrodepositing parameters are selected so that all said electrodeposited metallic material layers have a same thickness ranging from 20 microns to 5 cm and wherein part-to-part variability obtained is manifested by a ratio of maximum layer thickness to average layer thickness of less than ±20% and/or ratio of layer thickness standard deviation to average layer thickness of less than ±20% and/or in the case of four or more substrates a kurtosis of less than 10.

20. The method of claim 2 or claim 3, further comprising imprinting synchronized plating schedules on said power supplies using a central control module.

21. The method of claim 1, 2 or 3, further comprising programming a plating schedule on said power supplies, wherein the plating schedule comprises a multi-step schedule to modulate grain size of said electrodeposited metallic material layers.

22. The method of claim 1, 2 or 3, wherein said substrates are tubular parts which are being rotated while said electrical charge is applied.

23. The method of claim 1, 2 or 3, wherein said substrates are permanent substrates comprising a metallized polymer.

24. The method of claim 1, 2 or 3, wherein said substrates are permanent substrates comprising a graphite filled polymer.

25. The method of claim 1, 2 or 3, wherein said ratio between the total number of power supplies and the total number of substrates is <1.

* * * * *